US010760430B2

(12) United States Patent
Lacy et al.

(10) Patent No.: US 10,760,430 B2
(45) Date of Patent: Sep. 1, 2020

(54) ADAPTIVELY OPENING BACKUP COOLING PATHWAY

(71) Applicant: General Electric Company, Schenectady, NY (US)

(72) Inventors: Benjamin Paul Lacy, Greer, SC (US); Brian Peter Arness, Simpsonville, SC (US); Victor John Morgan, Simpsonville, SC (US); Stephen William Tesh, Simpsonville, SC (US)

(73) Assignee: General Electric Company, Schnectady, NY (US)

( * ) Notice: Subject to any disclaimer, the term of this patent is extended or adjusted under 35 U.S.C. 154(b) by 478 days.

(21) Appl. No.: 15/609,598

(22) Filed: May 31, 2017

(65) Prior Publication Data

US 2018/0347372 A1 Dec. 6, 2018

(51) Int. Cl.
*F01D 5/08* (2006.01)
*F01D 5/18* (2006.01)
(Continued)

(52) U.S. Cl.
CPC ..... *F01D 5/186* (2013.01); *F01D 5/187* (2013.01); *F01D 9/041* (2013.01); *F01D 9/065* (2013.01);
(Continued)

(58) Field of Classification Search
CPC .... F01D 5/186; F01D 5/187; F05D 2260/202; F05D 2260/204
See application file for complete search history.

(56) References Cited

U.S. PATENT DOCUMENTS 3,626,568 A 12/1971 Silverstein et al.
3,990,837 A * 11/1976 Snell ..... F23R 3/04 60/752
(Continued)

FOREIGN PATENT DOCUMENTS

EP 1375825 A1 1/2004
EP 1655454 A1 5/2006
(Continued)

OTHER PUBLICATIONS

"Resbond 907GF" 2350 Degrees Adhesive & Sealant Cotronics Corporation, n.d, 1 page.
(Continued)

*Primary Examiner* — Ninh H. Nguyen
(74) *Attorney, Agent, or Firm* — Charlotte Wilson; Hoffman Warnick LLC

(57) ABSTRACT

A hot gas path (HGP) component of an industrial machine includes primary and secondary cooling pathways. A body includes an internal cooling circuit carrying a cooling medium. A primary cooling pathway is spaced internally in the body and carries a primary flow of a cooling medium from an internal cooling circuit. A secondary cooling pathway is in the body and in fluid communication with an internal cooling circuit. The secondary cooling pathway is fluidly incommunicative and spaced internally from the primary cooling pathway. In response to an overheating event occurring, the secondary cooling pathway opens to allow a secondary flow of cooling medium through to the outer surface of the body and/or the primary cooling pathway. The primary flow flows in the primary cooling pathway prior to the overheating event, and the secondary flow of cooling medium does not flow until after an opening of the secondary cooling pathway.

24 Claims, 12 Drawing Sheets

(51) Int. Cl.
*F01D 9/04* (2006.01)
*F01D 9/06* (2006.01)

(52) U.S. Cl.
CPC .... *F05D 2230/30* (2013.01); *F05D 2260/202* (2013.01); *F05D 2260/204* (2013.01); *F05D 2260/84* (2013.01); *F05D 2270/3032* (2013.01); *F05D 2270/46* (2013.01)

(56) References Cited

U.S. PATENT DOCUMENTS 4,136,516 A * 1/1979 Corsmeier ..... F01D 5/185 415/114
5,269,653 A 12/1993 Evans
5,726,348 A 3/1998 Draghi et al.
6,265,022 B1 7/2001 Fernihough et al.
6,454,156 B1 9/2002 Taras, Jr. et al.
6,478,537 B2 11/2002 Junkin
7,241,107 B2 7/2007 Spanks, Jr. et al.
7,674,093 B2 * 3/2010 Lee ..... B22C 9/103 164/365
7,772,314 B2 8/2010 Fernihough et al.
7,909,581 B2 3/2011 Klein
7,950,902 B2 5/2011 Camhi et al.
8,574,671 B2 11/2013 Ahmad et al.
9,587,832 B2 * 3/2017 Dierberger ..... F23R 3/002
9,617,859 B2 4/2017 Morgan et al.
2004/0226682 A1 11/2004 Ehrhard et al.
2006/0263217 A1 11/2006 Spanks, Jr. et al.
2007/0036942 A1 2/2007 Steele
2007/0253815 A1 11/2007 Kopmels et al.
2008/0226871 A1 9/2008 Klein
2009/0074576 A1 * 3/2009 Brostmeyer ..... F01D 5/186 416/95
2010/0239409 A1 9/2010 Draper
2011/0011563 A1 1/2011 Steele
2011/0070095 A1 3/2011 Harron
2011/0097188 A1 4/2011 Bunker
2011/0189015 A1 8/2011 Shepherd
2011/0241297 A1 10/2011 Morgan et al.
2012/0183412 A1 7/2012 Lacy et al.
2012/0189435 A1 7/2012 Morgan et al.
2013/0052036 A1 2/2013 Smith
2013/0078110 A1 3/2013 Boyer
2013/0104517 A1 5/2013 Correia et al.
2013/0230394 A1 9/2013 Ellis et al.
2014/0099183 A1 4/2014 Morgan et al.
2015/0198062 A1 7/2015 Morgan et al.

FOREIGN PATENT DOCUMENTS

EP 2354453 A1 8/2011
EP 2716867 A1 4/2014

OTHER PUBLICATIONS

"High Temperature Ceramic-metallic Pastes", Aremco Products, Inc., Technical Bulletin A3, Jun. 2012, 2 pages.
Extended European Search Report and Opinion issued in connection with corresponding EP Application No. 18173988.9 dated Oct. 15, 2018.

* cited by examiner

ADAPTIVELY OPENING BACKUP COOLING PATHWAY

BACKGROUND OF THE INVENTION

The disclosure relates generally to cooling of components, and more particularly, to a primary cooling pathway near an outer surface of a hot gas path component and a backup, secondary cooling pathway internal of the primary cooling pathway.

Hot gas path components that are exposed to a working fluid at high temperatures are used widely in industrial machines. For example, a gas turbine system includes a turbine with a number of stages with blades extending outwardly from a supporting rotor disk. Each blade includes an airfoil over which the hot combustion gases flow. The airfoil must be cooled to withstand the high temperatures produced by the combustion gases. Insufficient cooling may result in undo stress and oxidation on the airfoil and may lead to fatigue and/or damage. The airfoil thus is generally hollow with one or more internal cooling flow circuits leading to a number of cooling holes and the like. Cooling air is discharged through the cooling holes to provide film cooling to the outer surface of the airfoil. Other types of hot gas path components and other types of turbine components may be cooled in a similar fashion.

Although many models and simulations may be performed before a given component is put into operation in the field, the exact temperatures to which a component or any area thereof may reach vary greatly due to component specific hot and cold locations. Specifically, the component may have temperature dependent properties that may be adversely affected by overheating. As a result, many hot gas path components may be overcooled to compensate for localized hot spots that may develop on the components. Such excessive overcooling, however, may have a negative impact on overall industrial machine output and efficiency.

Despite the presence of cooling passages many components also rely on a thermal barrier coating (TBC) applied to an outer surface thereof to protect the component. If a break or crack, referred to as a spall, occurs in a TBC of a hot gas path component, the local temperature of the component at the spall may rise to a harmful temperature. This situation may arise even though internal cooling circuits are present within the component at the location of the spall. One approach to a TBC spall provide a plug in a cooling hole under the TBC. When a spall occurs, the plug is removed typically through exposure to heat sufficient to melt the plug, the cooling hole opens and a cooling medium can flow from an internal cooling circuit fluidly coupled to the cooling hole. The plug may be porous to assist in its removal. This process reduces overcooling. Formation of the plug however is complex, requiring precise machining and/or precise thermal or chemical processing of materials to create the plug.

Another challenge regarding cooling is addressing the situation where a particular cooling feature becomes no longer operational, or the amount of cooling required to prevent further overheating increases.

BRIEF DESCRIPTION OF THE INVENTION

A first aspect of the disclosure provides a component for use in a hot gas path of an industrial machine, the component comprising: a body including an outer surface exposed to a working fluid having a high temperature in the hot gas path; an internal cooling circuit in the body carrying a cooling medium; a primary cooling pathway spaced internally from the outer surface in the body and in fluid communication with the internal cooling circuit, the primary cooling pathway fluidly communicating a primary flow of the cooling medium therethrough from the internal cooling circuit; and a secondary cooling pathway in the body and in fluid communication with the internal cooling circuit, the secondary cooling pathway fluidly incommunicative and spaced internally from the primary cooling pathway, wherein in response to an overheating event, the secondary cooling pathway opens at a first opening to at least one of the outer surface and the primary cooling pathway to allow a secondary flow of cooling medium through to the at least one of the outer surface and the primary cooling pathway from the secondary cooling pathway, wherein the primary flow of the cooling medium flows in the primary cooling pathway prior to the overheating event, and wherein the secondary flow of cooling medium does not flow in the plurality of interconnected secondary cooling pathways until after the overheating event.

A second aspect of the disclosure provides a component for use in a hot gas path of an industrial machine, the component comprising: a body including an outer surface; a thermal barrier coating over the outer surface, the thermal barrier coating exposed to a working fluid having a high temperature in the hot gas path; an internal cooling circuit in the body carrying a cooling medium; a primary cooling pathway spaced internally from the outer surface in the body and in fluid communication with the internal cooling circuit, the primary cooling pathway fluidly communicating a primary flow of the cooling medium therethrough from the internal cooling circuit; and a plurality of interconnected secondary cooling pathways in the body and in fluid communication with the internal cooling circuit, the plurality of interconnected secondary cooling pathways fluidly incommunicative and spaced internally from the primary cooling pathway, wherein in response to an overheating event, at least one of the plurality of interconnected secondary cooling pathways opens at a first opening to at least one of the outer surface and the primary cooling pathway to allow a secondary flow of cooling medium through to the at least one of the outer surface and the primary cooling pathway from the at least one of the plurality of interconnected secondary cooling pathways, wherein the primary flow of the cooling medium flows in the primary cooling pathway prior to the overheating event, and wherein the secondary flow of cooling medium does not flow in the plurality of interconnected secondary cooling pathways until after the overheating event.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

Figure 1:
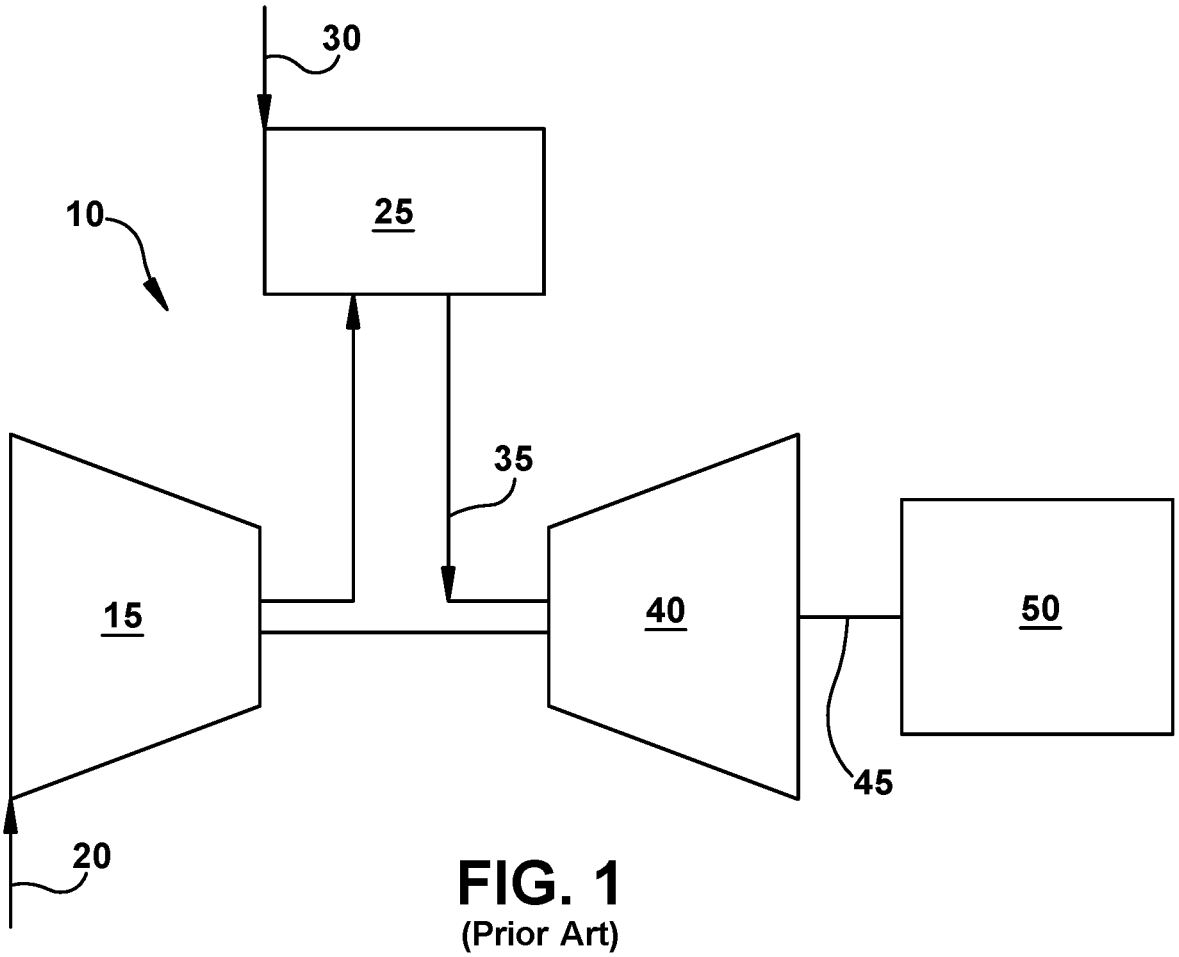
FIG. 1 (Prior Art)
FIG. 1 is a schematic diagram of an illustrative industrial machine having a hot gas path component in the form of a gas turbine system.

As an initial matter, in order to clearly describe the current disclosure it will become necessary to select certain terminology when referring to and describing relevant machine components within an industrial machine such as a gas turbine system. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows. The term "radial" refers to movement or position perpendicular to an axis. In cases such as this, if a first component resides closer to the axis than a second component, it will be stated herein that the first component is "radially inward" or "inboard" of the second component. If, on the other hand, the first component resides further from the axis than the second component, it may be stated herein that the first component is "radially outward" or "outboard" of the second component. It will be appreciated that such terms may be applied in relation to the center axis of the turbine.

As indicated above, the disclosure provides a hot gas path (HGP) component including adaptively opening cooling pathways therein. A primary cooling pathway is spaced internally from the outer surface in the body and in fluid communication with an internal cooling circuit. A secondary cooling pathway is also in the body and in fluid communication with an internal cooling circuit. The secondary cooling pathway is fluidly incommunicative and spaced internally from the primary cooling pathway. In response to an overheating event occurring, the secondary cooling pathway opens at a first opening to at least one of the outer surface and the primary cooling pathway to allow a secondary flow of cooling medium through to the at least one of the outer surface and the primary cooling pathway from the secondary cooling pathway. The overheating event may include any event in which a temperature reaches or exceeds a predetermined temperature of the body, causing the first opening to form from the secondary cooling pathway through the outer surface of the body and/or to the secondary cooling pathway. Where the first opening opens to the primary cooling pathway, and the overheating event warrants, the primary cooling pathway may open at a second opening to the outer surface. Various forms of an overheating event will be described in more detail herein. The HGP component can be made by additive manufacturing or conventional manufacturing.

Referring now to the drawings, in which like numerals refer to like elements throughout the several views, FIG. 1 shows a schematic view of an illustrative industrial machine in the form of a gas turbine system 10. While the disclosure will be described relative to gas turbine system 10, it is emphasized that the teachings of the disclosure are applicable to any industrial machine having a hot gas path component requiring cooling. Gas turbine system 10 may include a compressor 15. Compressor 15 compresses an incoming flow of air 20, and delivers the compressed flow of air 20 to a combustor 25. Combustor 25 mixes the compressed flow of air 20 with a pressurized flow of fuel 30 and ignites the mixture to create a flow of combustion gases 35. Although only a single combustor 25 is shown, gas turbine system 10 may include any number of combustors 25. Flow of combustion gases 35 is in turn delivered to a turbine 40. Flow of combustion gases 35 drives turbine 40 so as to produce mechanical work. The mechanical work produced in turbine 40 drives compressor 15 via a shaft 45 and an external load 50 such as an electrical generator and the like.

Gas turbine system 10 may use natural gas, liquid fuels, various types of syngas, and/or other types of fuels and blends thereof. Gas turbine system 10 may be any one of a number of different gas turbine engines offered by General Electric Company of Schenectady, N.Y. and the like. Gas turbine system 10 may have different configurations and may use other types of components. Teachings of the disclosure may be applicable to other types of gas turbine systems and or industrial machines using a hot gas path. Multiple gas turbine systems, or types of turbines, and or types of power generation equipment also may be used herein together.

Figure 2:
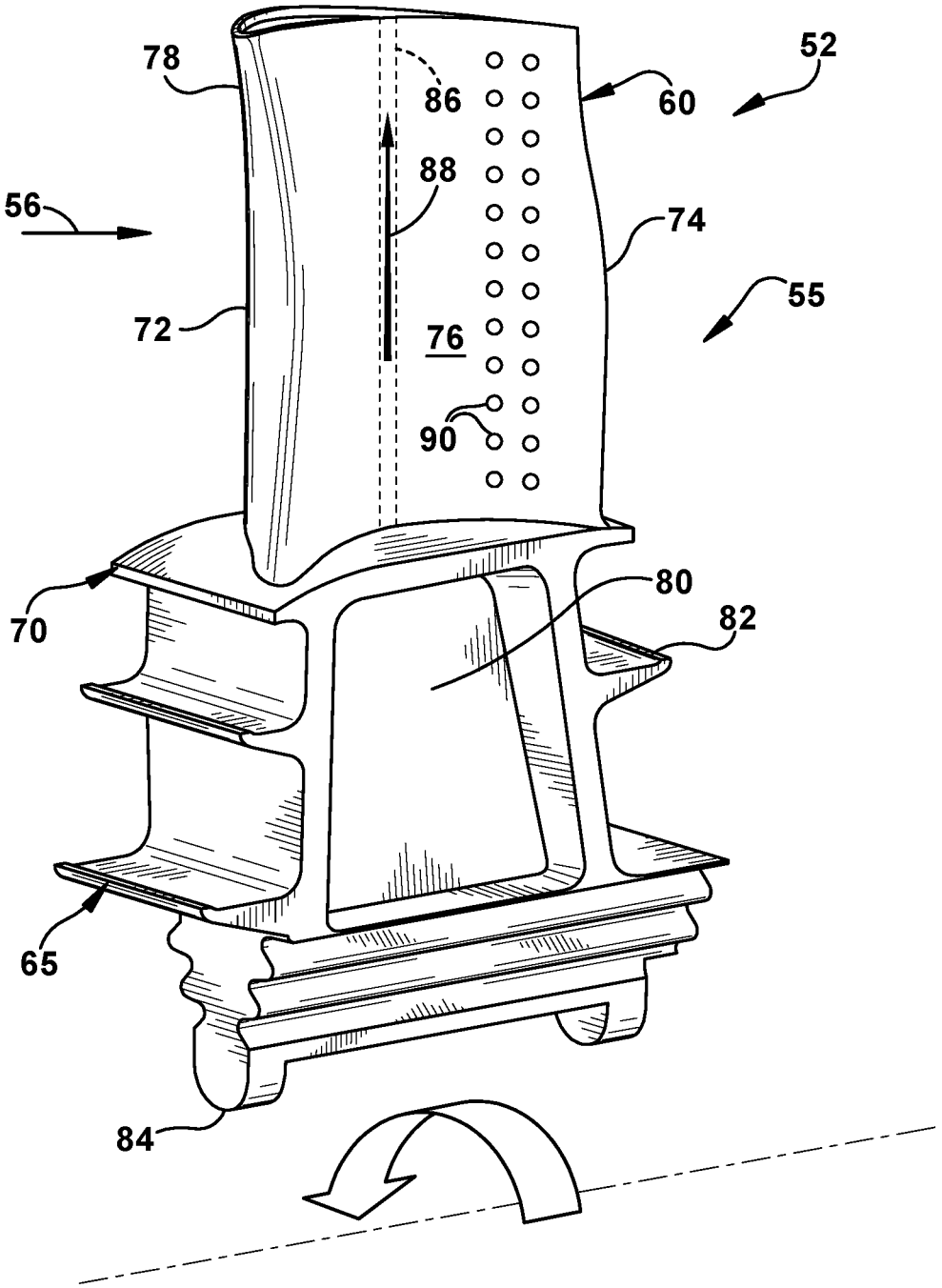
FIG. 2 (Prior Art)
FIG. 2 is a perspective view of a known hot gas path component in the form of a turbine blade.

FIG. 2 shows an example of a hot gas path (HGP) component 52 in the form of a turbine blade 55 that may be used in a hot gas path (HGP) 56 of turbine 40 and the like. While the disclosure will be described relative to HGP component 52 in the form of turbine blade 55 and more specifically an airfoil 60 or wall thereof, it is emphasized that the teachings of the disclosure are applicable to any HGP component requiring cooling. Generally described, turbine blade 55 may include airfoil 60, a shank portion 65, and a platform 70 disposed between airfoil 60 and shank portion 65. Airfoil 60 generally extends radially upward from platform 70 and includes a leading edge 72 and a trailing edge 74. Airfoil 60 also may include a concave surface defining a pressure side 76 and an opposite convex surface defining a suction side 78. Platform 70 may be substantially horizontal and planar. Shank portion 65 may extend radially downward from platform 70 such that platform 70 generally defines an interface between airfoil 60 and shank portion 65. Shank portion 65 may include a shank cavity 80. Shank portion 65 also may include one or more angel wings 82 and a root structure 84 such as a dovetail and the like. Root structure 84 may be configured to secure, with other structure, turbine blade 55 to shaft 45 (FIG. 1). Any number of turbine blades 55 may be circumferentially arranged about shaft 45. Other components and or configurations also may be used herein.

Turbine blade 55 may include one or more cooling circuits 86 extending therethrough for flowing a cooling medium 88 such as air from compressor 15 (FIG. 1) or from another source. Steam and other types of cooling mediums 88 also may be used herein. Cooling circuits 86 and cooling medium 88 may circulate at least through portions of airfoil 60, shank portion 65, and platform 70 in any order, direction, or route. Many different types of cooling circuits and cooling mediums may be used herein in any orientation. Cooling circuits 86 may lead to a number of cooling holes 90 or other types of cooling pathways for film cooling about airfoil 60 or elsewhere. Other types of cooling methods may be used. Other components and or configurations also may be used herein.

Figure 3:
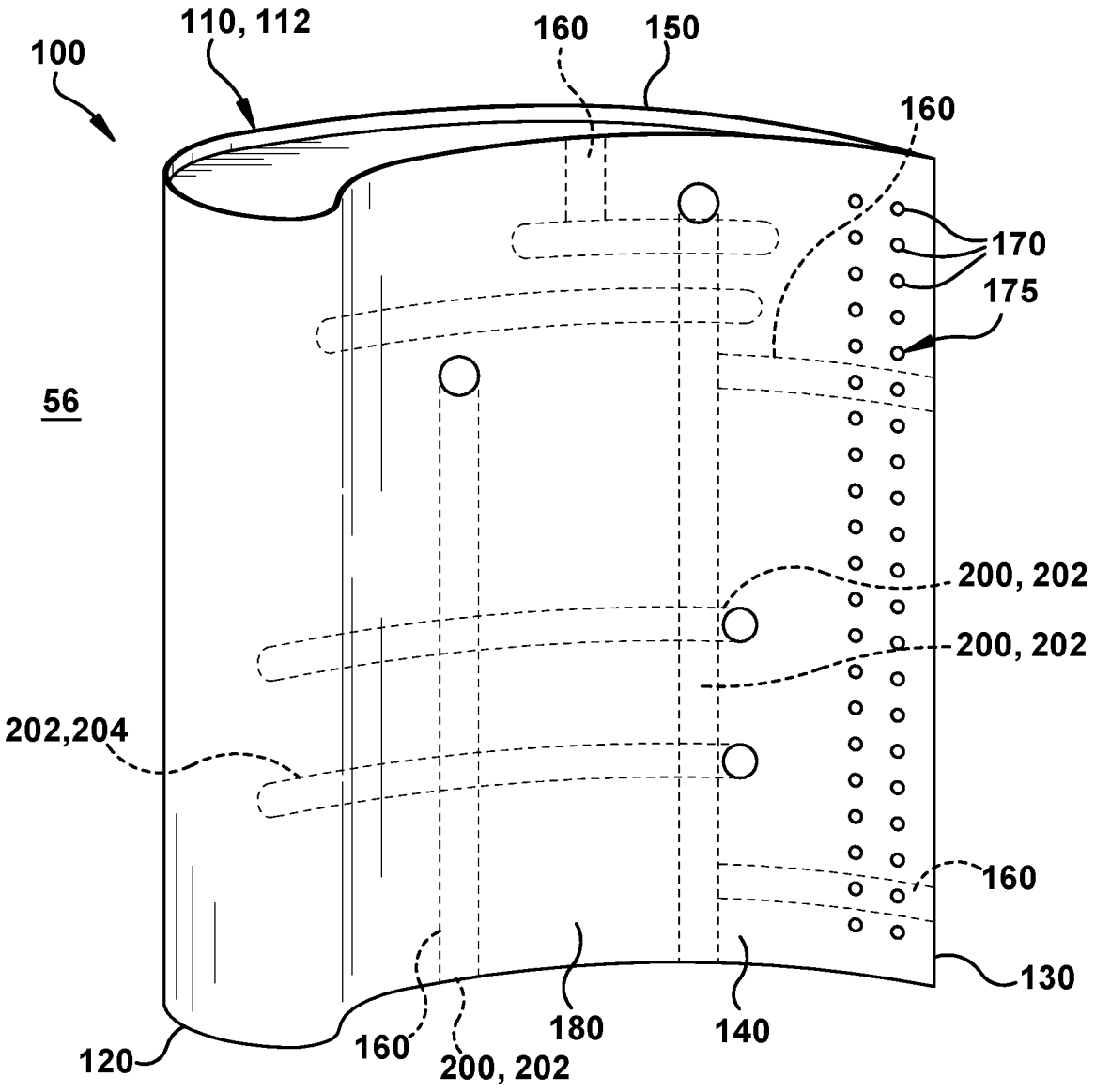
FIG. 3 is a perspective view of a portion of a hot gas path component according to embodiments of the disclosure without a thermal barrier coating (TBC) thereon.
Figure 4:
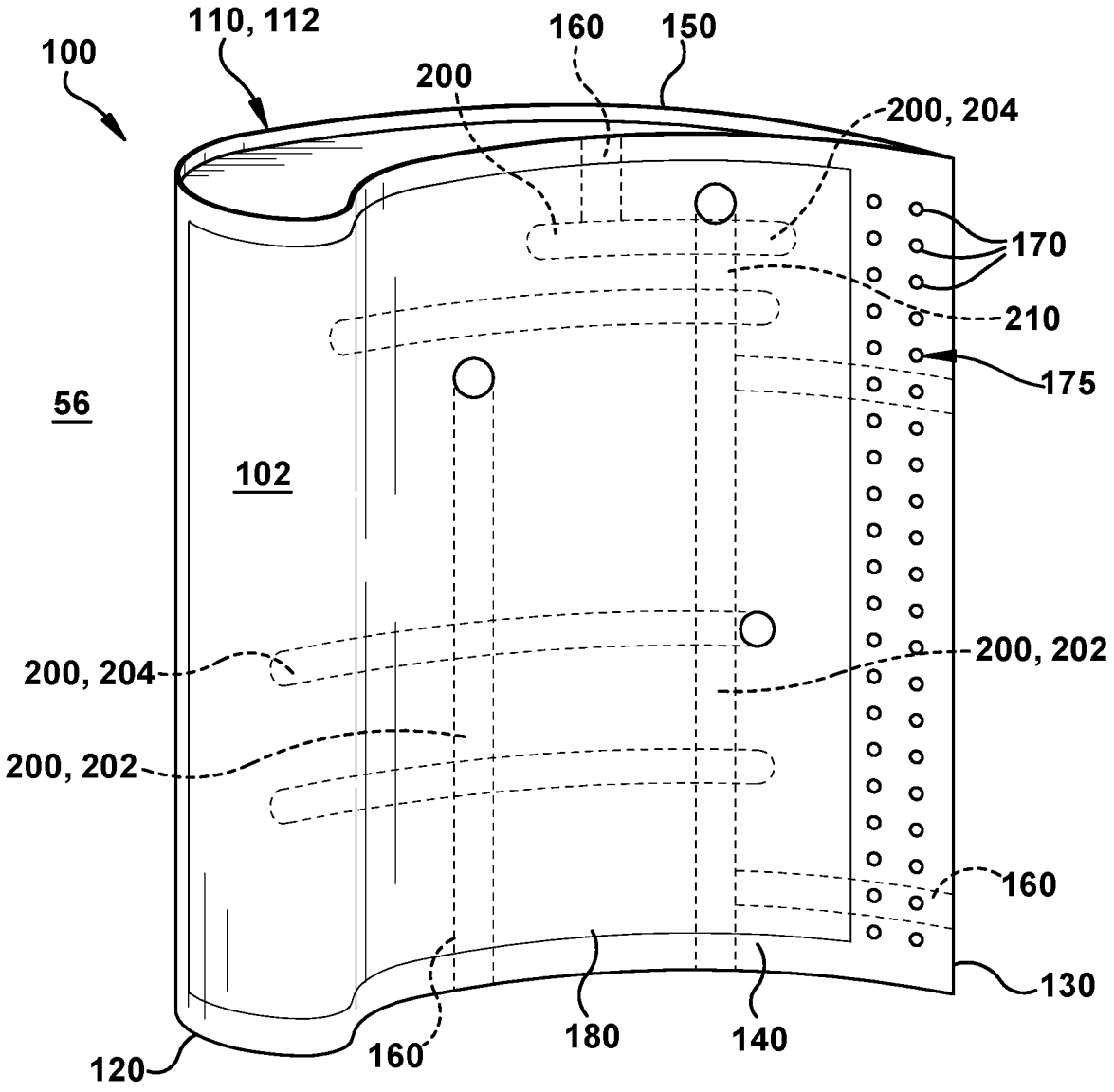
FIG. 4 is a perspective view of a portion of the HGP component of FIG. 3 including a thermal barrier coating according to embodiments of the disclosure.

FIGS. 3-8 show an example of a portion of an HGP component 100 as may be described herein. FIG. 3 is a perspective view of HGP component 100 without a thermal barrier coating (TBC) thereon, FIG. 4 is a perspective view of HGP component 100 with a TBC 102 thereon, and FIGS. 5-8 are cross-sectional views of a portion of HGP component without TBC 102. In this example, HGP component 100 may be an airfoil 110 and more particularly a sidewall thereof. HGP component 100 may be a part of a blade or a vane and the like. HGP component 100 also may be any type of air-cooled component including a shank, a platform, or any other type of hot gas path component of a blade or vane. As noted, other types of HGP components and other configurations may be used herein. Similar to that described above, airfoil 110 may include a leading edge 120 and a trailing edge 130. Likewise, airfoil 110 may include a pressure side 140 and a suction side 150.

Airfoil 110 also may include one or more internal cooling circuits 160 (FIGS. 3 and 5) therein. As shown in phantom in FIG. 3 and shown in cross-section in FIGS. 5 and 7, internal cooling circuits 160 may lead to a number of open cooling pathways 170 such as a number of cooling holes 175. A variety of internal cooling circuits 160 may be employed, not all of which are shown. Cooling holes 175 may extend through an outer surface 180 of airfoil 110 or elsewhere. Outer surface 180 is exposed to a working fluid having a high temperature in HGP 56. As used herein, "high temperature" depends on the form of industrial machine, e.g., for gas turbine system 10, high temperature may be any temperature greater than 100° C. Internal cooling circuits 160 and cooling holes 175 serve to cool airfoil 110 and components thereof with a cooling medium 190 (FIG. 5) therein. Any type of cooling medium 190, such as air, steam, and the like, may be used herein from any source. While one common source of cooling medium 190 is shown, one or more sources may be employed. Cooling holes 175 may have any size, shape, or configuration. Any number of cooling holes 175 may be used herein. Cooling holes 175 may extend to outer surface 180 in an orthogonal or non-orthogonal manner. Other types of open cooling pathways 170 may be used herein. Other components and or configurations may be used herein.

As shown in FIG. 3-4, HGP component 100, e.g., airfoil 110, also may include a number of other adaptively opening cooling pathways 200 including: a primary cooling pathway 202 and a backup, secondary cooling pathway 204 (hereinafter "secondary cooling pathway 204") according to embodiments of the disclosure. As will be described herein, secondary cooling pathway 204 may, in certain embodiments, include a plurality of interconnected secondary cooling pathways 204, i.e., they are fluidly communicative with one another. Similarly, primary cooling pathway 202 may include a plurality of primary cooling pathways 202 that may or may not be interconnected. HGP component 100 may include a body 112, e.g., sidewall of airfoil 110, including outer surface 180. Internal cooling circuit 160 and pathways 200 may be in body 112 carrying cooling medium 190. While internal cooling circuit 160 will be described herein and generally shown as a singular circuit or pathway, it is understood that the circuit may be duplicated and that pathways 202, 204 as shown may be coupled to the same internal cooling circuit or different internal cooling circuits. Cooling pathways 200 may have any size, shape (e.g., circular, round, polygonal, etc.), or configuration. In one embodiment, cooling pathways 200 may have a dimension of approximately 0.25 millimeters (mm) to 2.5 mm, and nominally, approximately 0.76 mm to 1.52 mm. In one embodiment, primary and secondary cooling pathways 202, 204 may have different sizes, e.g., secondary cooling pathway 204 may be smaller than primary cooling pathway 202. (See e.g., FIGS. 6 and 8) In one embodiment, cooling pathways 200 have a circular cross-section.

Figure 5:
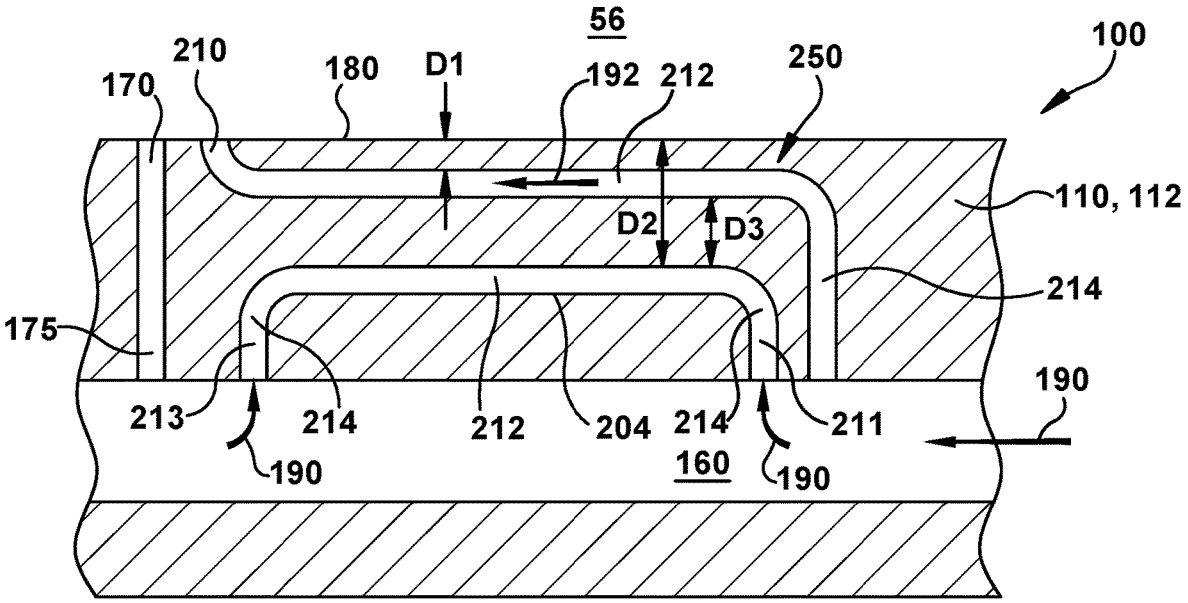
FIG. 5 is a first cross-sectional view of a portion of the HGP component including primary and secondary cooling pathways according to embodiments of the disclosure.
Figure 6:
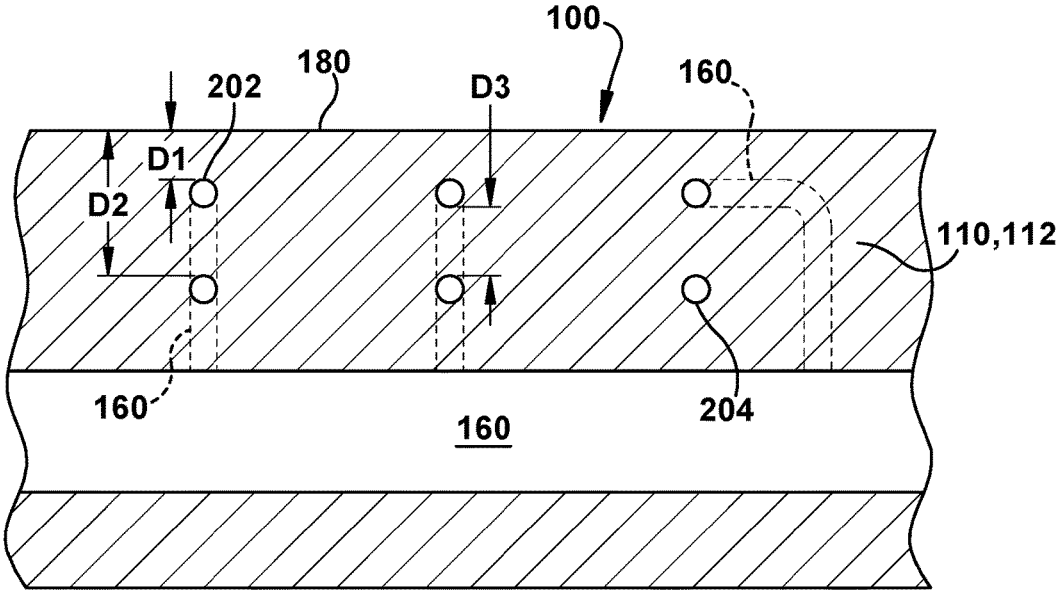
FIG. 6 is a second cross-sectional view of the portion of the HGP component of FIG. 5 including primary and secondary cooling pathways according to embodiments of the disclosure.
Figure 7:
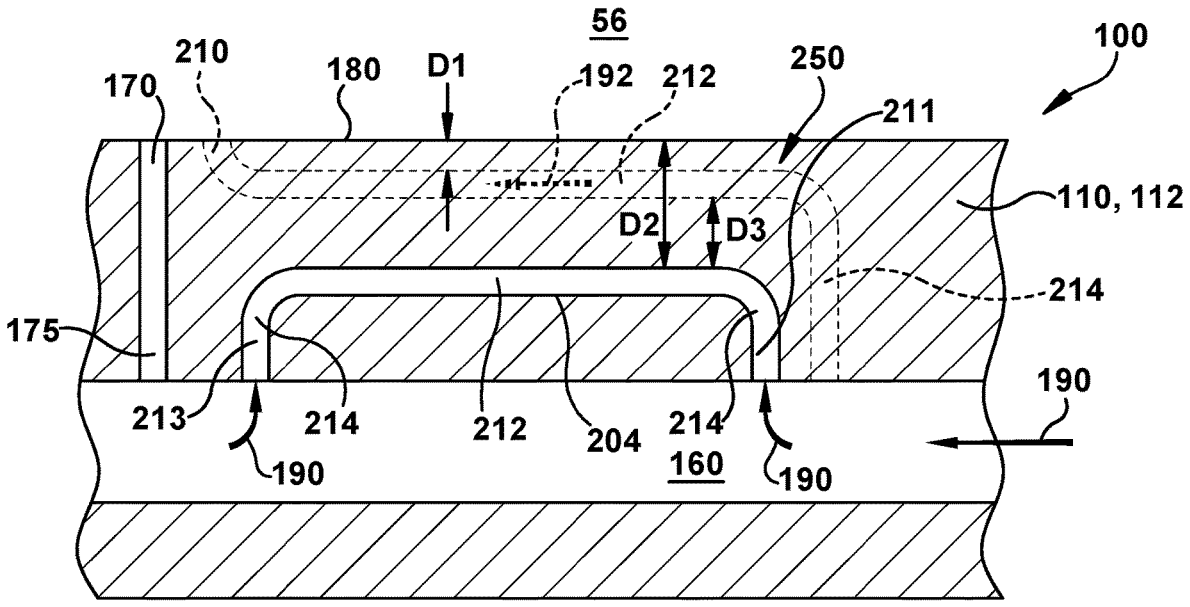
FIG. 7 is a first cross-sectional view of a portion of the HGP component including primary and secondary cooling pathways according to another embodiment of the disclosure.
Figure 8:
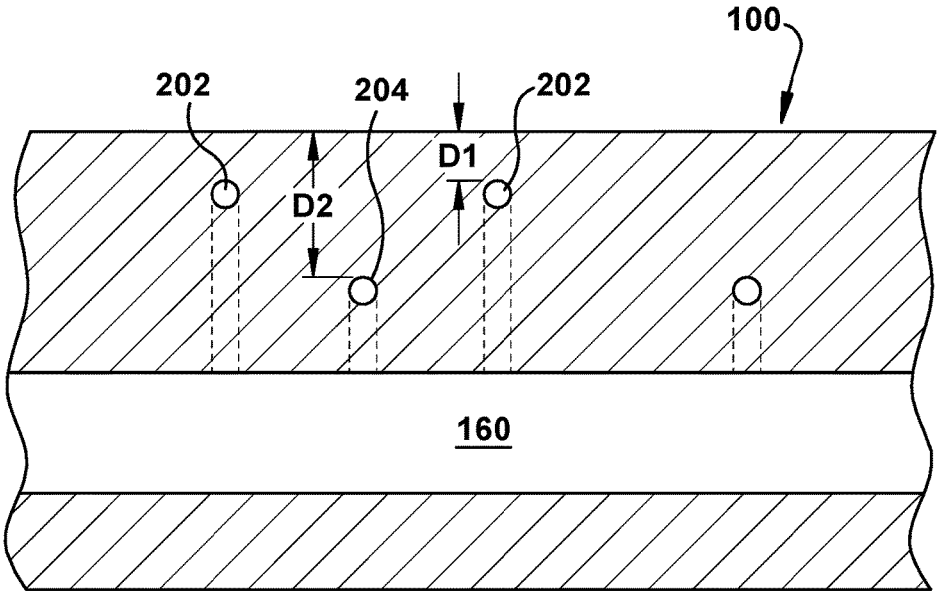
FIG. 8 is a second cross-sectional view of the portion of the HGP component of FIG. 7 including primary and secondary cooling pathways according to embodiments of the disclosure.

As shown for example in FIGS. 5-8, cooling pathways 200 are positioned internally from outer surface 180. Primary cooling pathway 202 may extend along and may be spaced internally from outer surface 180 in a substantially consistent manner such that primary cooling pathway 202 extends parallel along and internally from outer surface 102, e.g., within +/−1-3° variance. FIGS. 5 and 6 show primary cooling pathway 202 and secondary cooling pathway 204 aligned relative to outer surface 180 (i.e., over one another as viewed perpendicularly from outer surface 180), while FIGS. 7 and 8 shows primary cooling pathway 202 and secondary cooling pathway 204 laterally offset relative to one another (i.e., into and out of page in FIG. 7) so they are not aligned relative to outer surface 180. Hence, primary cooling pathway 202 is shown in phantom in FIG. 7. FIG. 6 shows the same portion of HGP component 100 from FIG. 5 in a lateral cross-section (perpendicular to longitudinal cross-section of FIG. 5).

As shown in FIGS. 5 and 6, primary cooling pathway 202 may be parallel with secondary cooling pathway 204. Further, primary cooling pathway 202 is aligned with secondary cooling pathway 204 relative to outer surface 180, i.e., directly over one another as viewed perpendicular to outer surface 180. In contrast, as shown in FIG. 8, primary cooling pathway 202 and secondary cooling pathway 204 may be parallel with each other but laterally offset from one another. That is, they may be not be over one another along their lengths 212 relative to outer surface 180, i.e., they are not directly over one another as viewed perpendicular to outer surface 180. In any event, primary cooling pathway 202 may be positioned internally at a first spacing D1 from outer surface 180, and secondary cooling pathway 204 may be positioned internally at a secondary spacing D2 from outer surface 180. In one embodiment, second spacing D2 may be approximately 0.25 mm to 3.56 mm, and nominally, approximately 0.51 mm to 1.52 mm, and first spacing D1 may be approximately 0.12 mm to 1.27 mm, and nominally, approximately 1.02 mm. In any event, first spacing D1 is less than second spacing D2. In the FIGS. 5-8 embodiments, first spacing D1 and second spacing D2 are substantially consistent along lengths 212 such that cooling pathways 200 extends parallel along and internally from outer surface 180. In other embodiments, some variation of first and second spacing D1, D2 may be possible to accommodate structural variations such as but not limited to: a varied shape of outer surface 180, surface roughness of outer surface 180, variation of cooling pathways 200 as they progress through body 112, other internal structure that must be routed around, etc. First spacing D1 can vary so long as it is sufficiently thin to allow for opening of body 112 to outer surface 180 at a location when necessary, as will be described herein. Similarly, second spacing D2, and more particularly, a third spacing D3 between primary cooling pathway 202 and secondary cooling pathway 204, can vary. For example, second spacing D2 can be sized sufficiently thin to allow for opening of body 112 from secondary cooling pathway 204 to outer surface 180 when necessary. Further, third spacing D3 can be sized sufficiently thin to allow for opening of body 112 at a location within primary cooling pathway 202 when necessary, i.e., from primary cooling pathway 202 to secondary cooling pathway 204. In one embodiment, third spacing D3 may be approximately 0.13 mm to 1.54 mm, and nominally, approximately 0.51 mm.

In one embodiment, as shown in FIGS. 5 and 7, primary cooling pathway 202 extend towards outer surface 180 and is open to outer surface 180 (including any TBC) at an open end 210 in a manner similar to cooling holes 175. However, primary cooling pathway 202 need not exit through outer surface 180 in all instances, i.e., it could simply supply another cooling pathway. In contrast, as shown in FIGS. 5 and 7, each second cooling pathway 204 may connect at both ends 211, 213 to internal cooling circuit 160. Alternatively, only one end 211 or 213 may be coupled to internal cooling circuit 160, and the other end may terminate at a terminating end 215 (see e.g., FIGS. 11 and 18) in body 112. Secondary cooling pathways 204 are not open through outer surface 180, when constructed. Thus, secondary cooling pathways 204 are distinguishable from open cooling pathways 170 and cooling holes 175 that are permanently open to outer surface 180. Lengths 212 of either pathway 202, 204 can be any distance desired. As will be described herein, any number of cooling pathways 200 may be used herein, and they can extend in any direction and have any orientation within HGP component 100. In any event, cooling medium 190 does not flow through secondary cooling pathway 204 until an overheating event creates a first opening 230 to allowing flow therethrough. Consequently, as will be described further herein, a primary flow 192 (e.g., FIG. 5) of cooling medium 190 may flow in primary cooling pathway 202 prior to an overheating event, but a secondary flow 194 (e.g., FIGS. 13-20) of cooling medium 190 may not flow in secondary cooling pathway 204 until after an overheating event.

With reference to FIGS. 5 and 7, each cooling pathway 200 may include a length 212 extending along and spaced internally from outer surface 180. An additional connecting cooling pathway 214 may also fluidly couple cooling pathways 200, i.e., lengths 212, to internal cooling circuit(s) 160, but this segment may not be necessary depending on the location of internal cooling circuit(s) 160. (While internal cooling circuit 160 is labeled as one circuit or pathway herein, it is understood that it may include any number of cooling medium circuits or pathways).

It is emphasized that FIGS. 5-8 show just a couple of embodiments of how primary and secondary cooling pathways 202, 204 can be arranged for initial description purposes. Practically any arrangement in which secondary cooling pathways 204 can open to outer surface 180 and/or secondary cooling pathways 202 are possible. In the latter case, primary cooling pathway 202 and secondary cooling pathway 204 can overlap so that secondary cooling pathway 204 can open to primary cooling pathway 202 alone, or to primary cooling pathway 202 and outer surface. Practically any arrangement in which pathways 202, 204 overlap such that an opening from secondary cooling pathway 204 can open to outer surface 180 and/or primary cooling pathway 202 is within the scope of the disclosure.

To further illustrate, FIGS. 9-12 show schematic plan views of various arrangements of primary cooling pathway 202 relative to secondary cooling pathways 204. It is emphasized that the examples shown are not comprehensive and that a large variety of alternatives may be possible. In FIGS. 9-12, primary cooling pathways 202 are shown with solid lines and secondary cooling pathways 204 are shown with dashed lines. Potential locations for internal cooling circuit 160 to cooling pathways 200 are shown with circles or ovals, and terminating ends 215 (FIG. 11) are shown with dots. Any number of internal cooling circuits 160 may couple to cooling pathways 200, e.g., one for both, one for each, more than one for each, etc. In any of the embodiments, secondary cooling pathway(s) 204 is spaced internally from primary cooling pathway 202, as in FIGS. 5-8.

Figure 9:
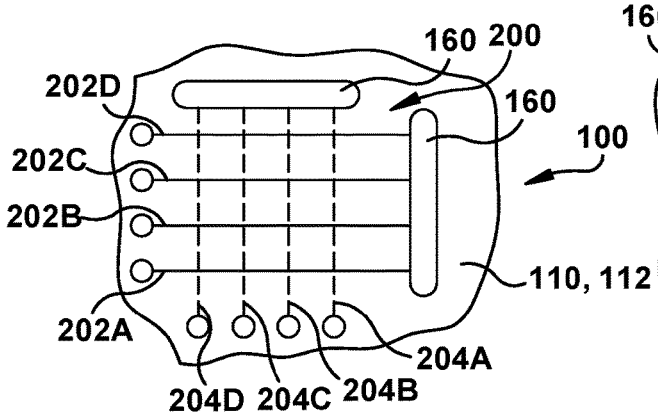
FIG. 9 is a schematic plan view of a portion of the HGP component illustrating an arrangement of the primary and secondary cooling pathways according to embodiments of the disclosure.

FIG. 9 shows an embodiment in which secondary cooling pathway 204 includes a plurality of secondary cooling pathways 204A-D and the primary cooling pathway 202 includes a plurality of primary cooling pathways 202A-D. Each of the pluralities may include any number of pathways. In any event, plurality of secondary cooling pathways 204 are spaced internally from plurality of primary cooling pathways 202, as in FIGS. 5-8. Here as in other embodiments, secondary cooling pathway 204 does not parallel primary cooling pathway 202. Rather, they cross under/over one another.

Figure 10:
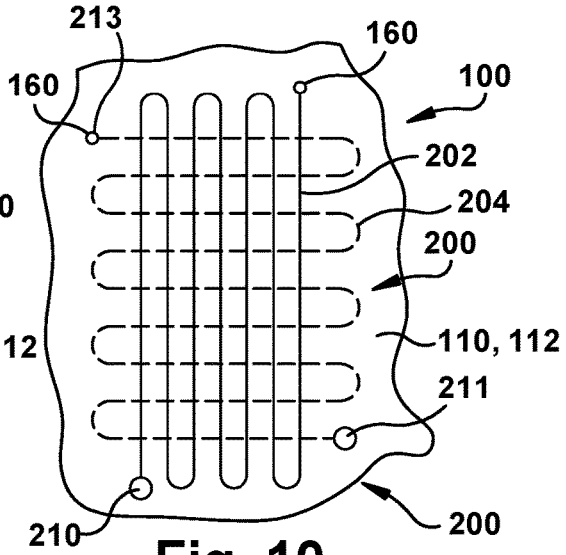
FIG. 10 is a schematic plan view of a portion of the HGP component illustrating an arrangement of the primary and secondary cooling pathways according to embodiments of the disclosure.
Figure 11:
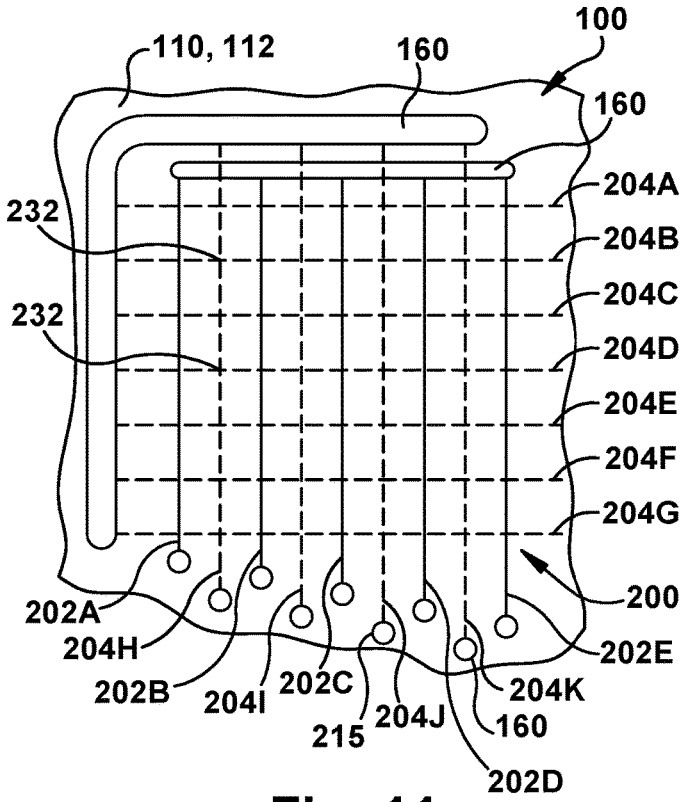
FIG. 11 is a schematic plan view of a portion of the HGP component illustrating an arrangement of the primary and secondary cooling pathways according to embodiments of the disclosure.

FIG. 10 shows an embodiment in which each cooling pathway 202, 204 are laid out in a sinusoidal pattern, but in a perpendicular manner to one another. FIG. 11 shows an embodiment in which a plurality of interconnected secondary cooling pathways 204A-K and a plurality of primary cooling pathways 202A-E are provided. Interconnected secondary cooling pathways 202A-K are spaced internally from plurality of primary cooling pathways 202A-E and can feed secondary flow 194 of cooling medium 190 to at least one of the outer surface 180 and at least one of plurality of primary cooling pathways 202A-E. In the example shown, plurality of secondary cooling pathways 204 are arranged in a net shape internally of plurality of primary cooling pathways 202. That is, secondary cooling pathways 204 include a set of pathways 204A-G that extend in a first direction (e.g., up/down page) and another set of pathways 204H-K that extend in a perpendicular second direction (e.g., across page). In one embodiment, set of secondary cooling pathways 204A-K are fluidly interconnected at their junctions 232 such that the same secondary flow 194 is in all of them and such that if one opens, they all feed to that opening. In this case, while all of the secondary cooling pathways 204A-K are shown fluidly coupled to a respective internal cooling circuit 160, only one of them need be so connected. In another embodiment, secondary cooling pathways 204A-K do not join together at junctions 232 but are all separately coupled to an internal cooling circuit 160. In FIG. 11, secondary cooling pathways 204 cross primary cooling pathways 202, i.e., secondary pathways 204 pass under but are not fluidly communicative with and do not intersect primary pathways 202. Here also, certain secondary cooling pathway(s), e.g., 204H-K, are laterally offset from and parallel primary cooling pathway(s) 204. (This structure is similar to that of FIGS. 7-8). In this case, it is possible for a first opening 230 to occur from outer surface 180 directly to secondary cooling pathway 204 where a temperature exceeds the predetermined temperature of body 112, bypassing primary cooling pathway 202. While a net shape has been illustrated in FIG. 11, pathways 200 can have any two dimensional or three dimensional arrangement necessary to provide the desired cooling, e.g., webbed, rounded, helical, etc. While arrangements are shown with plural cooling pathways 202, 204, as shown in one example in FIG. 11, any of the arrangements can be implemented using one or more primary cooling pathways 202 and/or one or more secondary cooling pathways 204. Further, cooling pathways 202, 204 need not meet at perpendicular angles, and need not be linear. In arrangements where a number of cooling pathways 202, 204 are used, spacing between adjacent pathways need not be equal.

Figure 12:
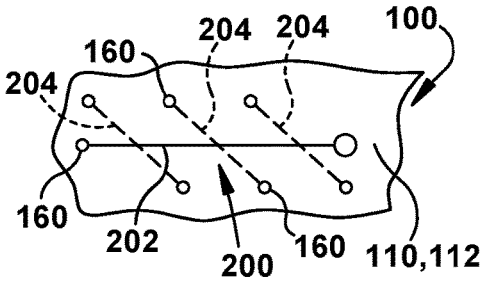
FIG. 12 is a schematic plan view of a portion of the HGP component illustrating an arrangement of the primary and secondary cooling pathways according to embodiments of the disclosure.

FIG. 12 shows an embodiment in which a secondary cooling pathway 204 crosses (under) a primary cooling pathway 202 at a non-perpendicular angle. That is, secondary cooling pathway(s) 204 does not parallel (nor is perpendicular) to primary cooling pathway(s) 202. FIG. 12 also shows an embodiment including a single primary cooling pathway 202 over a plurality of secondary cooling pathways 204. As noted, the teachings of the disclosure can be applied where there is a plurality of both cooling pathways 202, 204, or just a plurality of one of them and a single version of the other.

Figure 18:
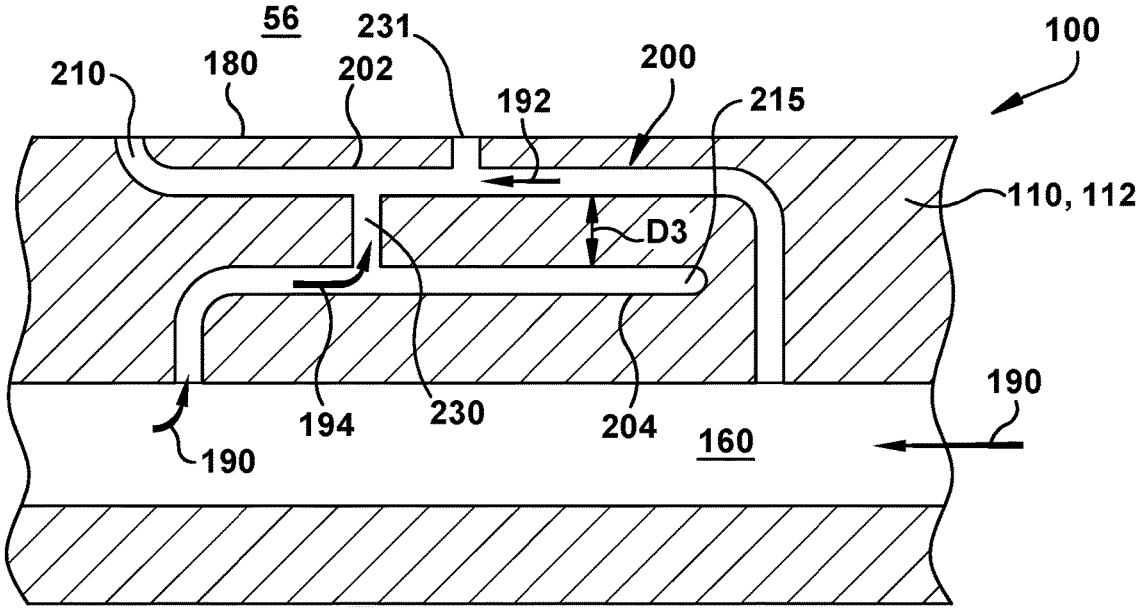
FIG. 18 is a cross-sectional view of a portion of an HGP component including openings to the primary and secondary cooling pathways according to embodiments of the disclosure.
Figure 19:
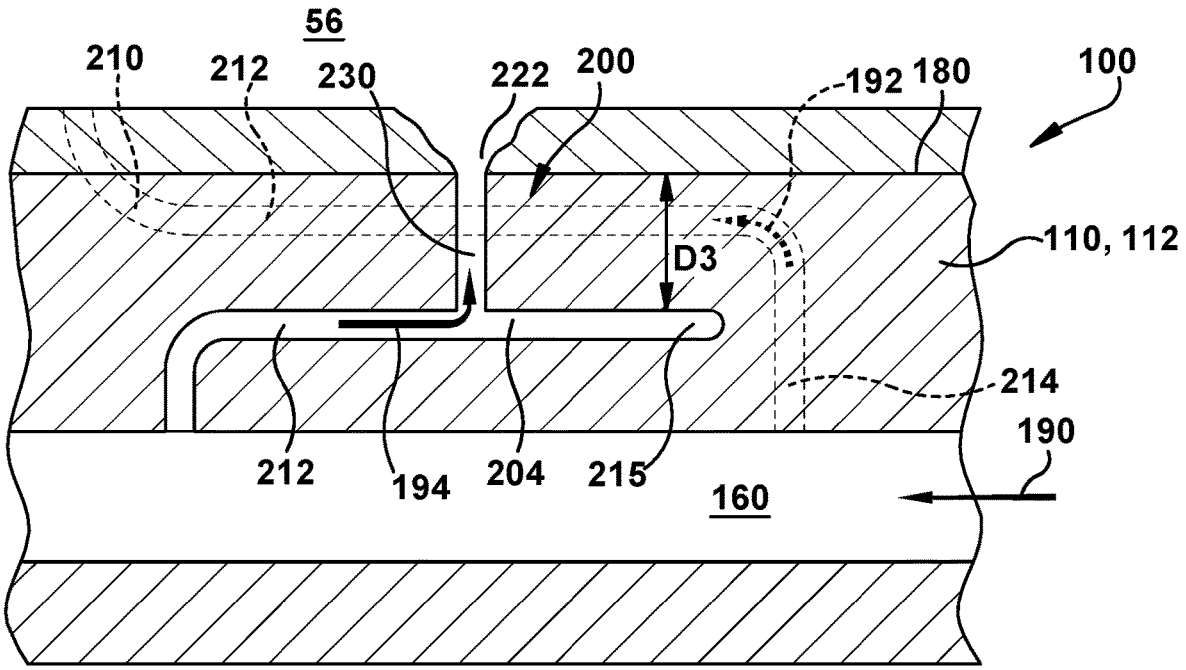
FIG. 19 is a cross-sectional view of the portion of the HGP component including an opening from the second cooling pathway to an outer surface and including a thermal barrier coating (TBC) according to embodiments of the disclosure.
Figure 20:
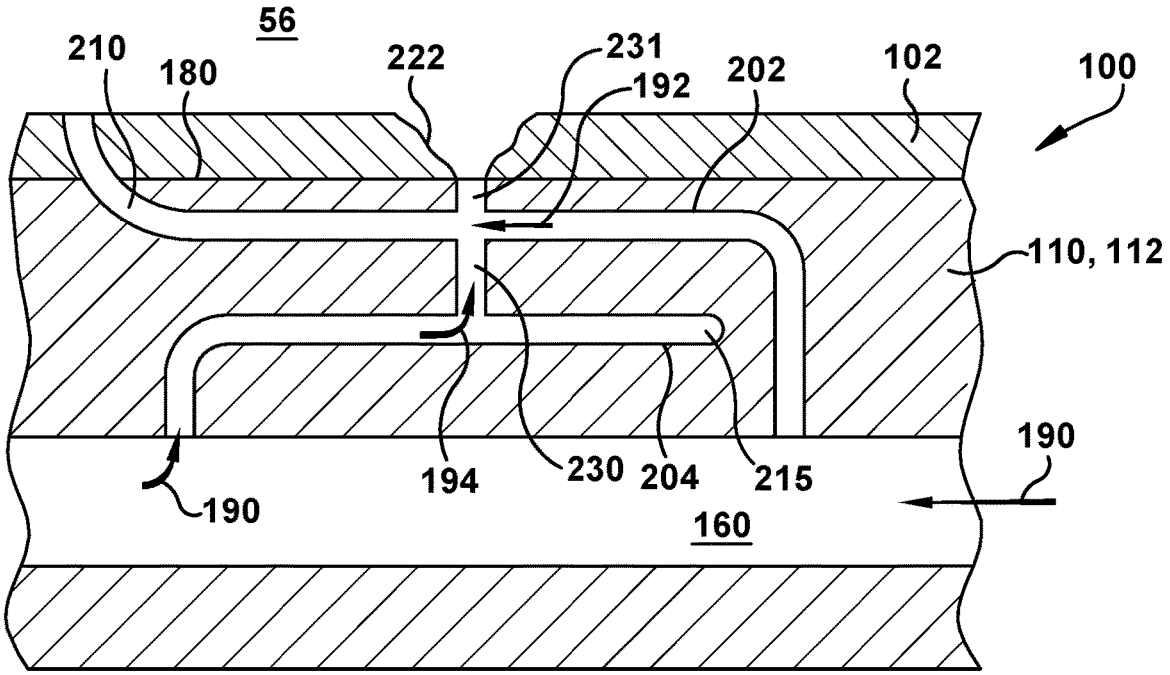
FIG. 20 is a cross-sectional view of a portion of the HGP component including openings to the primary and secondary cooling pathways and including a thermal barrier coating (TBC) according to embodiments of the disclosure.

Cooling pathways 200, i.e., at least portions of outer surface 180, may optionally include a thermal barrier coating (TBC) 102 thereover. FIGS. 3, 5-8 and 13-18 show embodiments that do not include TBC 102, and FIGS. 4, 19 and 20 show embodiments that include TBC 102. As shown in FIGS. 4, 19 and 20, in contrast to cooling holes 175 (FIG. 3), TBC 102 is positioned over outer surface 180 in at least a portion of HGP component 100 to cover cooling pathways 200. Open ends 210 of primary cooling pathway 202, when provided, may extend through TBC 102. When employed, TBC 102 extends over outer surface 180, and is exposed to HGP 56 including a working fluid having a high temperature, as previously noted. TBC 102 may include any now known or later developed layers of materials configured to protect outer surface 180 from thermal damage (e.g., creep, thermal fatigue cracking and/or oxidation) such as but not limited to: zirconia, yttria-stabilized zirconia, a noble metal-aluminide such as platinum aluminide, MCrAlY alloy in which M may be cobalt, nickel or cobalt-nickel alloy. TBC 102 may include multiple layers such as but not limited to a bond coat under a thermal barrier layer.

According to embodiments of the disclosure, in response to an overheating event occurring, secondary cooling pathway 204 opens at first opening 230 to at least one of outer surface 180 and primary cooling pathway 202 to allow a secondary flow 194 of cooling medium 190 through from secondary cooling pathway 204. Secondary flow 194 acts to cool the overheating area and possibly downstream areas, e.g., in or around outer surface 180 and/or primary cooling pathway 202. A location 224 (e.g., FIG. 13) at which an opening occurs may be at, near or distanced from the cause of an overheating event and may be anywhere along lengths 212 of cooling pathways 200. In this fashion, even though the exact positioning of on overheating event cannot be accurately predicted, secondary cooling pathway 204 can provide adequate cooling over length 212. Further, with regard to primary cooling pathway 202, location 224 can be at any location about primary cooling pathway 202, e.g., above, below, within, to the side, etc.

An "overheating event" may take a number of forms according to embodiments of the disclosure. In one embodiment, the overheating event may include a temperature at a location reaching or exceeding a predetermined temperature of body 112, causing an opening(s) to form from secondary cooling pathway 204 to provide a secondary flow 194 of cooling medium 190, e.g., to primary cooling pathway 202 and/or outer surface 180. As will be described, an opening may form from secondary cooling pathway 204 at, near or distant from the location of the overheating event. As used herein, the "predetermined temperature of body 112" is a temperature at which body 112 will change state in such a way as to allow its removal to create an opening, e.g., through sublimation, ashing, cracking, or melting thereof. That is, the high temperature causes a deterioration, or removal of a portion of body 112 at, near or distant from the overheating event, creating an opening, e.g., first opening 230 from secondary cooling pathway 204 allowing a secondary flow 194 of cooling medium 190 therethrough. The overheating event may have a variety of different causes such as but not limited to an at least partial blockage of a cooling pathway, a reduced cooling medium flow in a cooling pathway for reasons other than a blockage, or simply an unanticipated overheating area. In addition, in any of the embodiments described herein, an amount of overheating can determine a size of opening(s), which automatically provides increased cooling for higher temperatures and less cooling for lower temperatures.

Reference will now be made to FIGS. 13-20 to describe a variety of illustrative overheating events and ways in which secondary cooling pathway 204 may operate to provide adaptive, backup cooling.

Figure 13:
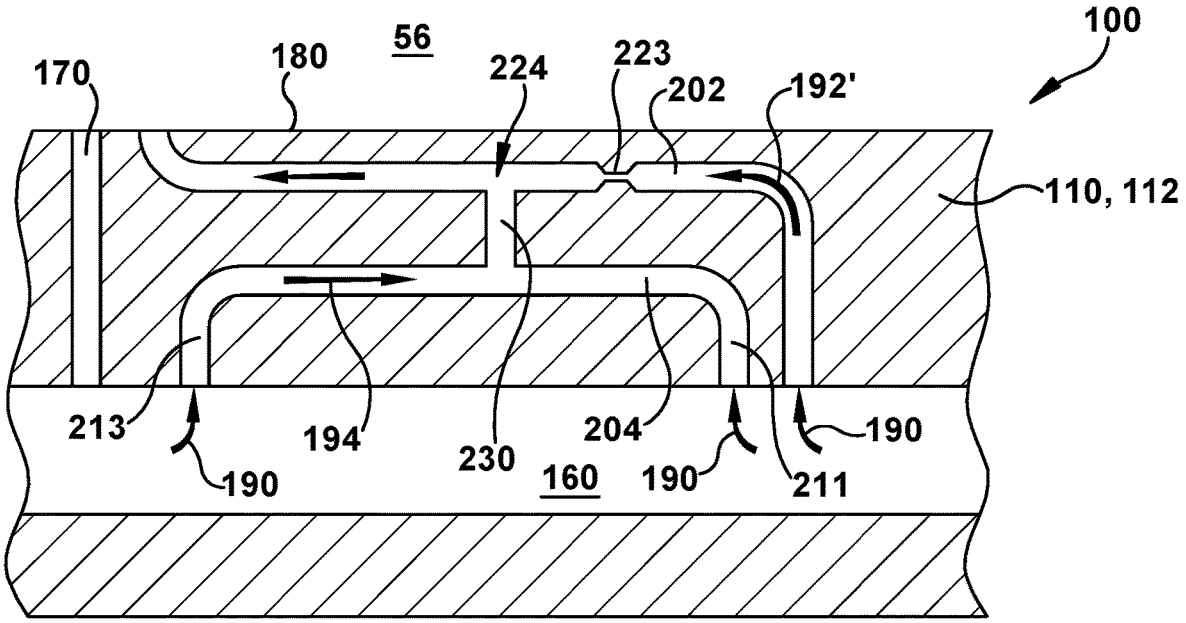
FIG. 13 is a cross-sectional view of the portion of the HGP component of FIG. 5 including a first opening from the secondary cooling pathway according to embodiments of the disclosure.
Figure 14:
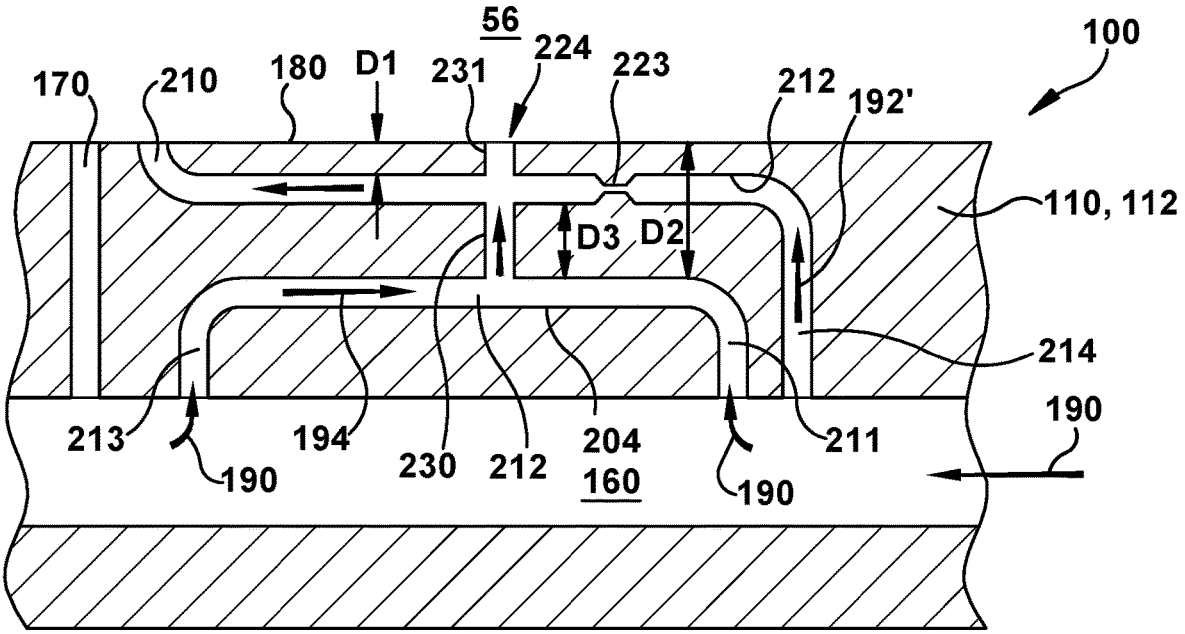
FIG. 14 is a cross-sectional view of the portion of the HGP component of FIG. 5 including a first opening from the secondary cooling pathway and a second opening from the primary cooling pathway according to embodiments of the disclosure.
Figure 15:
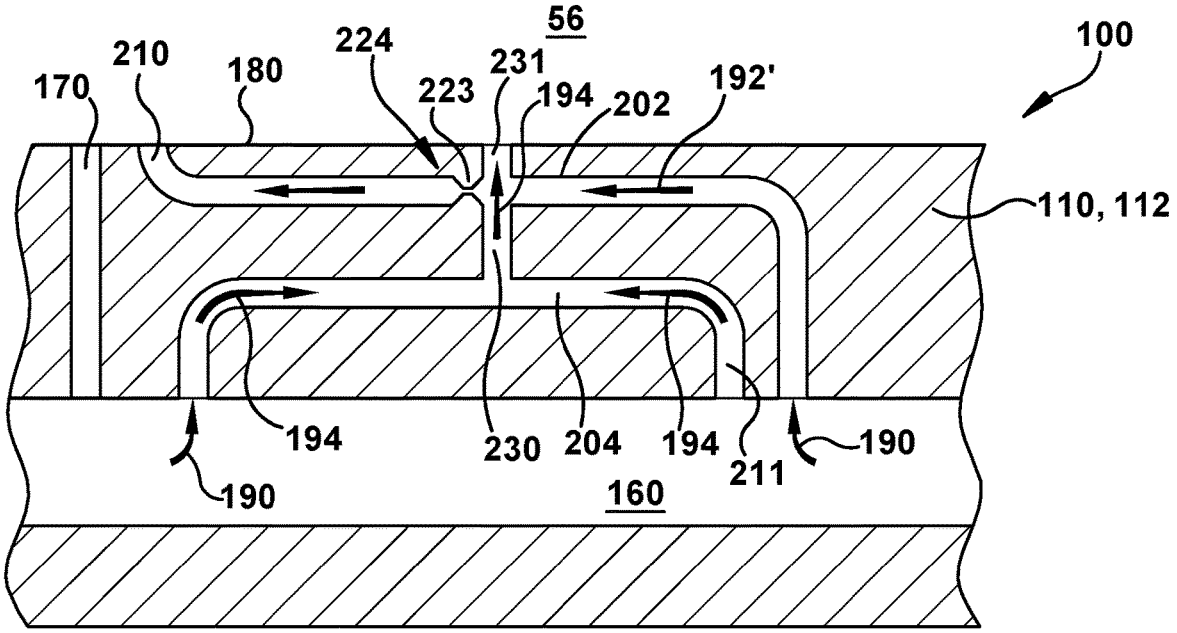
FIG. 15 is a cross-sectional view of the portion of the HGP component of FIG. 5 including a first opening to the primary cooling pathway and a second opening from the primary cooling pathway according to another embodiment of the disclosure.

In FIGS. 13-15, an overheating event is illustrated as an at least partial blockage 223 of primary cooling pathway 202, e.g., by a collapse, clog or other failure, causing an at least reduced primary flow 192' of cooling medium 190. FIGS. 13-15 show this form of overheating event relative to the FIGS. 5 and 6 embodiments (with aligned pathways 202, 204); it is emphasized however that teachings of FIGS. 13-15 are equally applicable to the FIGS. 7 and 8 embodiments (laterally offset pathways 202, 204). Here, the overheating event includes a temperature in primary cooling pathway 202 reaching or exceeding the predetermined temperature of body 112 causing secondary cooling pathway 204 to open at first opening 230 (at or near blockage 223) to primary cooling pathway 202, allowing secondary flow 194 of cooling medium 190 through to at least primary cooling pathway 202. FIG. 13 shows one example in which the overheating event creates only a first opening 230 (downstream of blockage 223) from secondary cooling pathway 204 to primary cooling pathway 202, allowing a secondary flow 194 of cooling medium 190 to provide cooling to primary cooling pathway 202 downstream of the at least partial blockage 223. FIG. 14 shows another example, similar to FIG. 13, but in which not just first opening 230 is formed, but also a second opening 231 forms from primary cooling pathway 202 to outer surface 180. In this case, the overheating event includes a temperature of outer surface 180 over primary cooling pathway 202 reaching or exceeding a predetermined temperature of body 112 causing primary cooling pathway 202 to open at second opening 231 to outer surface 180, and a temperature in the open primary cooling pathway 202 reaching or exceeding the predetermined temperature of body 112 causing secondary cooling pathway 204 to open at first opening 230 to primary cooling pathway 202, allowing secondary flow 194 of cooling medium through to 180 outer surface and primary cooling pathway 202. Here, exposure of primary cooling pathway 202 to HGP 56, despite primary flow 192 of cooling medium 190 flowing through second opening 231, will still create a further unanticipated hot spot within third spacing D3 (i.e., inner wall of primary cooling pathway 202). Where the temperature in open primary cooling pathway 202 reaches or exceeds the predetermined temperature of body 112, secondary cooling pathway 204 may open at first opening 230 in open primary cooling pathway 202 to allow secondary flow 194 of cooling medium 190 therethrough to provide additional cooling. That is, the continuing high temperature of HGP 56 causes a deterioration, or removal of third spacing D3, creating first opening 230 to secondary cooling pathway 204 allowing a secondary flow 194 of cooling medium 190 therethrough. In addition, an amount of overheating can determine a size of first opening 230 to secondary cooling pathway 204, which automatically provides increased cooling for higher temperatures and less cooling for lower temperatures. In this embodiment, either opening 230, 231 may occur first. In another alternative embodiment, first opening 230 may occur alone, i.e., the overheating event in the form of at least partial blockage 223 includes a temperature of outer surface 180 over primary cooling pathway 202 reaching or exceeding a predetermined temperature of body 112 causing second cooling pathway 204 to open directly to outer surface 180 (see e.g., FIGS. 17 and 19). This latter embodiment is more likely to occur relative to the laterally offset configurations of FIGS. 7 and 8.

In FIG. 15, the overheating event also includes at least partial blockage 223, but openings 230, 231 occur upstream of the at least partial blockage 223. In FIGS. 14-15, since primary cooling pathway 202 and secondary cooling pathway 204 are aligned, the locations of second opening 231 may be over first opening 230, i.e., that is the locations of openings 230, 231 are aligned relative to outer surface 180. That may not be the case in all instances, e.g., see FIG. 18.

Figure 16:
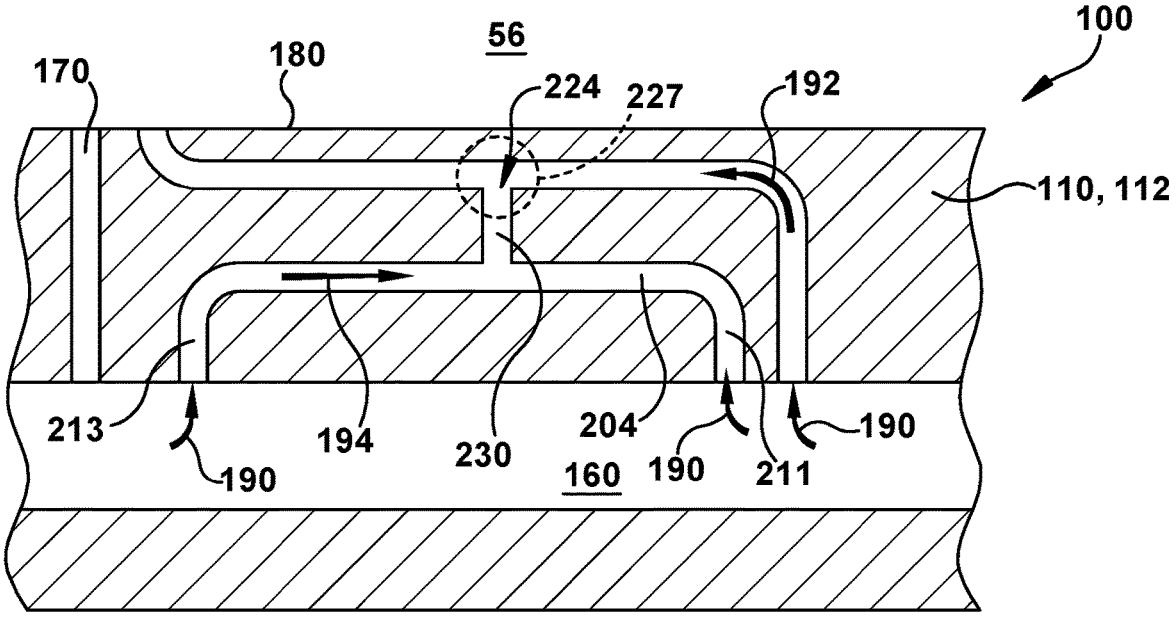
FIG. 16 is a cross-sectional view of the portion of the HGP component of FIG. 5 including a first opening from the secondary cooling pathway according to embodiments of the disclosure.

As shown in FIG. 16, the overheating event may also simply include an unexpected hot spot 227. That is, a location of the overheating event is an area that does not appear to have any damage, but has a high temperature exceeding the predetermined temperature of body 112. Unexpected hot spot 227 may be, for example, the result of primary cooling pathway 202 or surrounding structure not having been designed to accommodate a higher than expected temperature. While FIG. 16 has been shown only creating first opening 230 from secondary cooling pathway 204 to primary cooling pathway 202, it is understood that second opening 231 from primary cooling pathway 202 to outer surface 180, as in FIGS. 14 and 15, could also be formed with this type of overheating event. Indeed, either of the FIGS. 14-15 embodiments are possible with an overheating event as described relative to FIG. 16.

Figure 17:
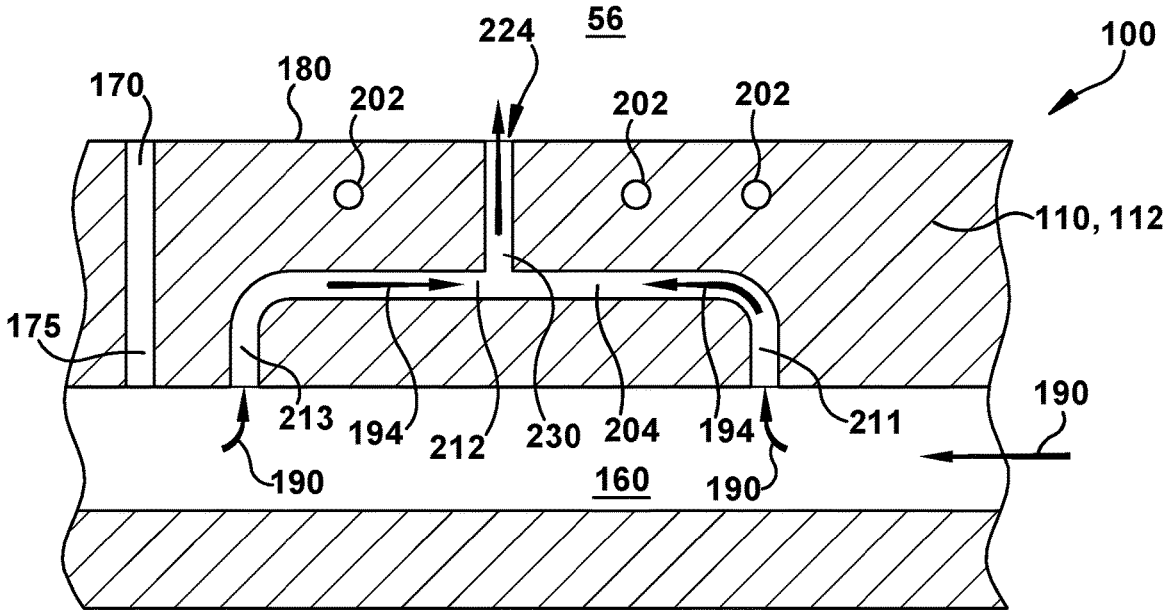
FIG. 17 is a cross-sectional view of an portion of an HGP component including a first opening from the second cooling pathway to an outer surface thereof according to embodiments of the disclosure.

FIG. 17 shows an embodiment in which primary and secondary cooling pathways 202, 204 are not aligned. While shown as perpendicular to one another, like in FIG. 9 or 10, cooling pathways 202, 204 could also be laterally offset (like secondary cooling pathways 204H-K relative to primary cooling pathways 202A-E in FIG. 11) or are otherwise not aligned (like in any of FIGS. 9-12). In this case, overheating event includes a temperature of outer surface 180 over secondary cooling pathway 204 reaching or exceeding a predetermined temperature of body 112 causing secondary cooling pathway 204 to open at first opening 230 to outer surface 180, directing at least a portion of secondary flow 194 of cooling medium 190 therethrough. That is, secondary cooling pathway 204 opens directly to outer surface 180 through second spacing D2. In this fashion, overheating events that occur at locations where primary cooling pathways 202 are not present can still be adaptively cooled using secondary flow 194 of cooling medium 190.

As described relative to FIGS. 14 and 15, in some embodiments, first opening 230 and second opening 231 may be aligned relative to outer surface 180 and relative to one another. It is emphasized however that opening 230, 231 alignment may not occur in all instances as the locations at which one opening occurs may not cause the other opening to be aligned. As illustrated in FIG. 18, for example, second opening 231 is not aligned with first opening 230 relative to outer surface 180. For example, first opening 230 may be downstream of second opening 231 to outer surface 180 because the overheating event includes a sub-event that occurs downstream from where a portion of primary flow 192 is escaping through outer surface 180. (FIG. 18 also shows a secondary cooling pathway that terminates at a terminating end 215 within body 112). In other examples, as shown best by FIG. 15, first and second openings 230, 231 may be offset from each other relative to the plane of the page, or angularly offset from one another relative to primary cooling pathway 202.

FIGS. 19 and 20 show embodiments of the disclosure including TBC 102 over outer surface 180. That is, TBC 102 is over at least a portion of outer surface 180, and TBC 102 is exposed to the working fluid having the high temperature in HGP 56. Here, the overheating event may include the temperature of outer surface 180 reaching or exceeding the predetermined temperature of body 112 in response to a spall 222 occurring in TBC 102. Spall 222 may include any change in TBC 102 creating a thermal path to outer surface 180 from HGP 56 not previously present, e.g., a break or crack in, or displacement. In one embodiment, spall 222 may have a dimension of approximately 6 mm diameter. When spall 222 occurs, outer surface 180 would normally be exposed to the high temperatures and other extreme environments of HGP 56, where prior to spall 222 occurring outer surface 180 was protected by TBC 102.

TBC 102 may be applied to any embodiment described herein. FIGS. 19-20 show a couple of examples of overheating events with a TBC 102 that are similar to those of FIGS. 17 and 14, respectively. As shown in FIG. 19, in response to spall 222 in TBC 102 occurring over secondary cooling pathway 204 and the temperature reaching or exceeding a predetermined temperature of body 112, secondary cooling pathway 204 opens at first opening 230 directly to outer surface 180 to allow secondary flow 194 of cooling medium 190 therethrough. That is, because internal cooling circuit(s) 160 are fluidly coupled to secondary cooling pathway 204, secondary flow 194 of cooling medium 190 passes through first opening 230 and serves to cool airfoil 110 and body 112 and components thereof, despite spall 222. As noted, any type of cooling medium 190, such air, steam, and the like, may be used herein from any source. First opening 230 may be anywhere along length 212 of secondary cooling pathway 204. In this fashion, even though the exact positioning of spall 222 cannot be accurately predicted, cooling pathway 200 can provide adequate cooling over length 212. In addition, an extent of spall 222 determines a size of first opening 230 in secondary cooling pathway 204, which automatically provides increased cooling for larger spalls 222 (larger opening) and less cooling for smaller spalls 222 (smaller openings 230).

Referring to FIG. 20, and similar to operation described relative FIG. 14, in response to a temperature of outer surface 180 reaching or exceeding a predetermined temperature of body 112 due to a spall 222 in TBC 102, primary cooling pathway 202 may open at second opening 231. Further, in response to a temperature of open primary cooling pathway 202 reaching or exceeding a predetermined temperature of body 112, secondary cooling pathway 204 may open at first opening 230 to primary cooling pathway 202 to allow secondary flow 194 of cooling medium therethrough. In this example, first and second openings 230, 231 are aligned relative to outer surface 180, but as noted herein they may not be aligned. In one example, as shown in FIG. 20, exposure of primary cooling pathway 202 to HGP 56, despite primary flow 192 of cooling medium 190 flowing through second opening 231, will still create a further unanticipated hot spot within third spacing D3 (i.e., inner wall of primary cooling pathway 202). Where temperature in open primary cooling pathway 204 reaches or exceeds the predetermined temperature of body 112, secondary cooling pathway 204 opens at second opening 231 in open primary cooling pathway 202 to allow secondary flow 194 of cooling medium 190 therethrough to provide additional cooling. An amount of overheating can determine a size of first opening 230 to secondary cooling pathway 204, which automatically provides increased cooling for higher temperatures and less cooling for lower temperatures. In another alternative embodiment, first opening 230 may occur alone, i.e., the overheating event in the form of spall 22 may include a temperature of outer surface 180 over primary cooling pathway 202 reaching or exceeding a predetermined temperature of body 112 causing second cooling pathway 204 to open directly to outer surface 180. This latter embodiment is more likely to occur relative to the laterally offset configurations of FIGS. 7 and 8.

In any of the embodiments described herein, an amount of overheating can determine a size of opening(s) 230, 231, which automatically provides increased cooling for higher temperatures and less cooling for lower temperatures. While singular first openings 230 and singular second openings 231 have been illustrated, it is understood that each may include more than one opening of its type where the overheating event dictates. Further, while different overheating events have been described separately herein, it is understood that an overheating event may include one or more of the types of events described herein. While FIGS. 13-18 have been described with no TBC 102 and FIGS. 19-20 have been described relative to a TBC 102, it is recognized that the various embodiments may be applied whether a TBC is present or not. Further, the different embodiments of HGP component 100 are not mutually exclusive to the particular examples as shown in the drawings. Features described herein can be taken from other embodiments and combined where necessary in a manner other than that explicitly described.

Figure 21:
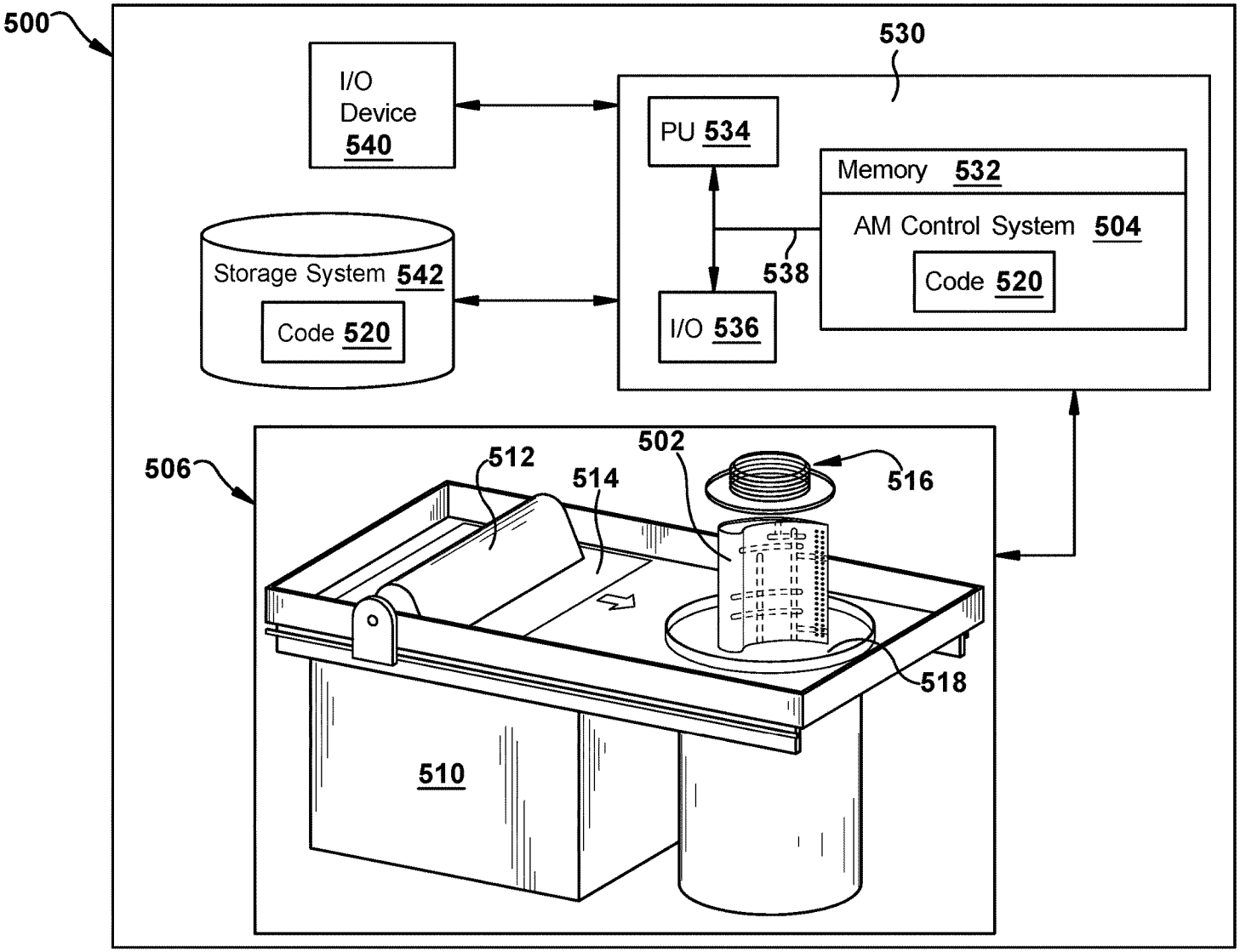
FIG. 21 is a block diagram of an additive manufacturing process including a non-transitory computer readable storage medium storing code representative of an HGP component according to embodiments of the disclosure.

HGP component 100 and cooling pathways 200 may be constructed entirely using conventional techniques, e.g., casting, machining, etc. Referring to FIG. 21, in accordance with embodiments of the disclosure, HGP component 100 and cooling pathways 200 may be additively manufactured. Additive manufacturing also allows for easy formation of much of the structure described herein, i.e., without very complex machining. As used herein, additive manufacturing (AM) may include any process of producing an object through the successive layering of material rather than the removal of material, which is the case with conventional processes. Additive manufacturing can create complex geometries without the use of any sort of tools, molds or fixtures, and with little or no waste material. Instead of machining components from solid billets of plastic or metal, much of which is cut away and discarded, the only material used in additive manufacturing is what is required to shape the part. Additive manufacturing processes may include but are not limited to: 3D printing, rapid prototyping (RP), direct digital manufacturing (DDM), binder jetting, selective laser melting (SLM) and direct metal laser melting (DMLM).

To illustrate an example of an additive manufacturing process, FIG. 21 shows a schematic/block view of an illustrative computerized additive manufacturing system 500 for generating an object 502, i.e., HGP component 100. In this example, system 500 is arranged for DMLM. It is understood that the general teachings of the disclosure are equally applicable to other forms of additive manufacturing. AM system 500 generally includes a computerized additive manufacturing (AM) control system 504 and an AM printer 506. AM system 500, as will be described, executes code 520 that includes a set of computer-executable instructions defining HGP component 100 (FIGS. 5-20) and cooling pathways 200, to physically generate the component using AM printer 506. Each AM process may use different raw materials in the form of, for example, fine-grain powder, liquid (e.g., polymers), sheet, etc., a stock of which may be held in a chamber 510 of AM printer 506. In the instant case, HGP component 100 (FIGS. 5-20) may be made of metal powder or similar materials. As illustrated, an applicator 512 may create a thin layer of raw material 514 spread out as the blank canvas from which each successive slice of the final object will be created. In other cases, applicator 512 may directly apply or print the next layer onto a previous layer as defined by code 520, e.g., where the material is a polymer or where a metal binder jetting process is used. In the example shown, a laser or electron beam 516 fuses particles for each slice, as defined by code 520, but this may not be necessary where a quick setting liquid plastic/polymer is employed. Various parts of AM printer 506 may move to accommodate the addition of each new layer, e.g., a build platform 518 may lower and/or chamber 510 and/or applicator 512 may rise after each layer.

AM control system 504 is shown implemented on computer 530 as computer program code. To this extent, computer 530 is shown including a memory 532, a processor 534, an input/output (I/O) interface 536, and a bus 538. Further, computer 530 is shown in communication with an external I/O device 540 and a storage system 542. In general, processor 534 executes computer program code, such as AM control system 504, that is stored in memory 532 and/or storage system 542 under instructions from code 520 representative of HGP component 100 (FIGS. 5-20), described herein. While executing computer program code, processor 534 can read and/or write data to/from memory 532, storage system 542, I/O device 540 and/or AM printer 506. Bus 538 provides a communication link between each of the components in computer 530, and I/O device 540 can comprise any device that enables a user to interact with computer 530 (e.g., keyboard, pointing device, display, etc.). Computer 530 is only representative of various possible combinations of hardware and software. For example, processor 534 may comprise a single processing unit, or be distributed across one or more processing units in one or more locations, e.g., on a client and server. Similarly, memory 532 and/or storage system 542 may reside at one or more physical locations. Memory 532 and/or storage system 542 can comprise any combination of various types of non-transitory computer readable storage medium including magnetic media, optical media, random access memory (RAM), read only memory (ROM), etc. Computer 530 can comprise any type of computing device such as a network server, a desktop computer, a laptop, a handheld device, a mobile phone, a pager, a personal data assistant, etc.

Additive manufacturing processes begin with a non-transitory computer readable storage medium (e.g., memory 532, storage system 542, etc.) storing code 520 representative of HGP component 100 (FIGS. 5-20). As noted, code 520 includes a set of computer-executable instructions defining object 502 that can be used to physically generate the object, upon execution of the code by system 500. For example, code 520 may include a precisely defined 3D model of HGP component 100 (FIGS. 5-20) and can be generated from any of a large variety of well-known computer aided design (CAD) software systems such as AutoCAD®, TurboCAD®, DesignCAD 3D Max, etc. In this regard, code 520 can take any now known or later developed file format. For example, code 520 may be in the Standard Tessellation Language (STL) which was created for stereolithography CAD programs of 3D Systems, or an additive manufacturing file (AMF), which is an American Society of Mechanical Engineers (ASME) standard that is an extensible markup-language (XML) based format designed to allow any CAD software to describe the shape and composition of any three-dimensional object to be fabricated on any AM printer. Code 520 may be translated between different formats, converted into a set of data signals and transmitted, received as a set of data signals and converted to code, stored, etc., as necessary. Code 520 may be an input to system 500 and may come from a part designer, an intellectual property (IP) provider, a design company, the operator or owner of system 500, or from other sources. In any event, AM control system 504 executes code 520, dividing HGP component 100 (FIGS. 5-20) into a series of thin slices that it assembles using AM printer 506 in successive layers of liquid, powder, sheet or other material. In the DMLM example, each layer is melted to the exact geometry defined by code 520 and fused to the preceding layer.

Subsequent to additive manufacture, HGP component 100 (FIGS. 5-20) may be exposed to any variety of finishing processes, e.g., minor machining, sealing, polishing, assembly to another part, etc.

In terms of the present disclosure, regardless of the manufacturing techniques used, TBC 102 may be optionally applied to outer surface 180 of HGP component 100 and over cooling pathways 200. TBC 102 may be applied using any now known or later developed coating techniques, and may be applied in any number of layers.

HGP component 100 according to embodiments of the disclosure provides cooling pathways 200 that only open in a location where unanticipated overheating above a predetermined temperature of body 112 is observed. The use of primary cooling pathway 202 backed up by secondary cooling pathway 202, where necessary, allows for cooling of overheating locations in an adaptive, autonomous manner and prevents overheating event to the underlying metal, which may significantly reduce nominal cooling flows. As noted relative to FIGS. 17 and 19, where secondary cooling pathway 204 is offset from primary cooling pathway 202, so it may alone provide cooling of overheating locations in an adaptive, autonomous manner and prevent damage to the underlying metal, which may significantly reduce nominal cooling flows. The temperatures reached, the size of spall 222 and/or previously formed openings (e.g., second openings 231 in FIG. 20) may dictate the size of the opening(s) created, and hence the amount of cooling.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A component for use in a hot gas path of an industrial machine, the component comprising:

a body including an outer surface exposed to a working fluid having a high temperature in the hot gas path;

an internal cooling circuit in the body carrying a cooling medium;

a primary cooling pathway spaced internally from the outer surface in the body and in fluid communication with the internal cooling circuit, the primary cooling pathway fluidly communicating a primary flow of the cooling medium therethrough from the internal cooling circuit;

a secondary cooling pathway in the body and in fluid communication with the internal cooling circuit, the secondary cooling pathway fluidly incommunicative and spaced internally from the primary cooling pathway, wherein in response to an overheating event, the secondary cooling pathway opens at a first opening to at least one of the outer surface or the primary cooling pathway to allow a secondary flow of cooling medium through to the at least one of the outer surface or the primary cooling pathway from the secondary cooling pathway, wherein the primary flow of the cooling medium flows in the primary cooling pathway prior to the overheating event, and wherein the secondary flow of cooling medium does not flow in the secondary cooling pathway until after the overheating event, wherein the overheating event includes a temperature of the outer surface over the primary cooling pathway reaching or exceeding a predetermined temperature of the body causing the primary cooling pathway to open at a second opening to the outer surface, and a temperature in the open primary cooling pathway reaching or exceeding the predetermined temperature of the body causing the secondary cooling pathway to open at the first opening to the primary cooling pathway, allowing the secondary flow of cooling medium through to the at least one of the outer surface or the primary cooling pathway; and a thermal barrier coating over at least a portion of the outer surface, the thermal barrier coating exposed to the working fluid having the high temperature in the hot gas path, wherein the overheating event includes a spall occurring in the thermal barrier coating, wherein an extent of the spall determines a size of the first opening.

2. The component of claim 1, wherein the overheating event includes a temperature reaching or exceeding a predetermined temperature of the body, causing the first opening to form from the secondary cooling pathway.

3. The component of claim 1, wherein the overheating event includes a temperature of the outer surface over the secondary cooling pathway reaching or exceeding a predetermined temperature of the body causing the secondary cooling pathway to open at the first opening to the outer surface directing at least a portion of the secondary flow of the cooling medium therethrough.

4. The component of claim 1, wherein the overheating event includes a temperature in the primary cooling pathway reaching or exceeding the predetermined temperature of the body causing the secondary cooling pathway to open at the first opening to the primary cooling pathway, allowing the secondary flow of cooling medium through to the primary cooling pathway.

5. The component of claim 4, wherein the overheating event includes an at least partial blockage of the primary cooling pathway causing at least a reduced primary flow of the cooling medium.

6. The component of claim 1, wherein the overheating event includes an at least partial blockage of the primary cooling pathway causing at least a reduced primary flow of the cooling medium.

7. The component of claim 1, wherein the first opening and the second opening are aligned relative to the outer surface.

8. The component of claim 1, wherein the secondary cooling pathway terminates within the body.

9. The component of claim 1, wherein the primary cooling pathway extends along and is spaced internally from the outer surface in a substantially consistent manner such that the primary cooling pathway extends parallel along and internally from the outer surface.

10. The component of claim 1, wherein the primary cooling pathway and the secondary cooling pathway have different sizes.

11. A component for use in a hot gas path of an industrial machine, the component comprising:

a body including an outer surface;

a thermal barrier coating over the outer surface, the thermal barrier coating exposed to a working fluid having a high temperature in the hot gas path;

an internal cooling circuit in the body carrying a cooling medium;

a primary cooling pathway spaced internally from the outer surface in the body and in fluid communication with the internal cooling circuit, the primary cooling pathway fluidly communicating a primary flow of the cooling medium therethrough from the internal cooling circuit; and a plurality of interconnected secondary cooling pathways in the body and in fluid communication with the internal cooling circuit, the plurality of interconnected secondary cooling pathways fluidly incommunicative and spaced internally from the primary cooling pathway, wherein in response to an overheating event, at least one of the plurality of interconnected secondary cooling pathways opens at a first opening to at least one of the outer surface or the primary cooling pathway to allow a secondary flow of cooling medium through to the at least one of the outer surface or the primary cooling pathway from the at least one of the plurality of interconnected secondary cooling pathways, wherein the primary flow of the cooling medium flows in the primary cooling pathway prior to the overheating event, and wherein the secondary flow of cooling medium does not flow in the plurality of interconnected secondary cooling pathways until after the overheating event, wherein the primary cooling pathway includes a plurality of primary cooling pathways, the plurality of interconnected secondary cooling pathways is spaced internally from the plurality of primary cooling pathways, wherein the plurality of interconnected secondary cooling pathways are arranged in a net shape internally of the plurality of primary cooling pathways.

12. The component of claim 11, wherein the overheating event includes a temperature reaching or exceeding a predetermined temperature of the body, causing the opening to form from at least one of the plurality of interconnected secondary cooling pathway.

13. The component of claim 11, wherein the overheating event includes a temperature of the outer surface over the at least one of the plurality of interconnected secondary cooling pathways reaching or exceeding a predetermined temperature of the body causing the at least one of the plurality of interconnected secondary cooling pathways to open at the first opening to the outer surface directing at least a portion of the secondary flow of the cooling medium therethrough.

14. The component of claim 11, wherein the overheating event includes a temperature in the primary cooling pathway reaching or exceeding the predetermined temperature of the body causing the at least one of the plurality of interconnected secondary cooling pathways to open at the first opening at or near the location to the primary cooling pathway, allowing the secondary flow of cooling medium through to the primary cooling pathway.

15. The component of claim 14, wherein the overheating event includes an at least partial blockage of the primary cooling pathway causing at least a reduced primary flow of the cooling medium.

16. The component of claim 11, wherein the overheating event includes a temperature of the outer surface over the primary cooling pathway reaching or exceeding a predetermined temperature of the body causing the primary cooling pathway to open at a second opening to the outer surface, and a temperature in the open primary cooling pathway reaching or exceeding the predetermined temperature of the body causing at least one of the plurality of interconnected secondary cooling pathway to open at the first opening to the primary cooling pathway, allowing the secondary flow of cooling medium through to at least one of the outer surfaces and the primary cooling pathway.

17. The component of claim 16, wherein the overheating event includes an at least partial blockage of the primary cooling pathway causing at least a reduced primary flow of the cooling medium.

18. The component of claim 16, wherein the first opening and the second opening are aligned relative to the outer surface.

19. The component of claim 11, wherein the plurality of interconnected secondary cooling pathways crosses the primary cooling pathway.

20. A component for use in a hot gas path of an industrial machine, the component comprising:

a body including an outer surface exposed to a working fluid having a high temperature in the hot gas path;

an internal cooling circuit in the body carrying a cooling medium;

a primary cooling pathway spaced internally from the outer surface in the body and in fluid communication with the internal cooling circuit, the primary cooling pathway fluidly communicating a primary flow of the cooling medium therethrough from the internal cooling circuit; and a secondary cooling pathway in the body and in fluid communication with the internal cooling circuit, the secondary cooling pathway fluidly incommunicative and spaced internally from the primary cooling pathway, wherein in response to an overheating event, the secondary cooling pathway opens at a first opening to at least one of the outer surface or the primary cooling pathway to allow a secondary flow of cooling medium through to the at least one of the outer surface or the primary cooling pathway from the secondary cooling pathway, wherein the primary flow of the cooling medium flows in the primary cooling pathway prior to the overheating event, wherein the secondary cooling pathway includes a plurality of interconnected secondary cooling pathways and the primary cooling pathways include a plurality of primary cooling pathways, the plurality of secondary cooling pathways spaced internally from the plurality of primary cooling pathways and feeding the secondary flow of cooling medium to the at least one of the outer surface or at least one of the plurality of primary cooling pathways, wherein the secondary flow of cooling medium does not flow in the plurality of interconnected secondary cooling pathways until after the overheating event, and wherein the plurality of secondary cooling pathways are interconnected and arranged in a net shape internally of the plurality of primary cooling pathways.

21. The component of claim 20, wherein the secondary cooling pathway does not parallel the primary cooling pathway.

22. The component of claim 20, wherein the secondary cooling pathway crosses the primary cooling pathway.

23. The component of claim 20, wherein the secondary cooling pathway is laterally offset from and parallels the primary cooling pathway.

24. A component for use in a hot gas path of an industrial machine, the component comprising:

a body including an outer surface;

a thermal barrier coating over the outer surface, the thermal barrier coating exposed to a working fluid having a high temperature in the hot gas path;

an internal cooling circuit in the body carrying a cooling medium;

a primary cooling pathway spaced internally from the outer surface in the body and in fluid communication with the internal cooling circuit, the primary cooling pathway fluidly communicating a primary flow of the cooling medium therethrough from the internal cooling circuit; and a plurality of interconnected secondary cooling pathways in the body and in fluid communication with the internal cooling circuit, the plurality of interconnected secondary cooling pathways fluidly incommunicative and spaced internally from the primary cooling pathway, wherein in response to an overheating event, at least one of the plurality of interconnected secondary cooling pathways opens at a first opening to at least one of the outer surface or the primary cooling pathway to allow a secondary flow of cooling medium through to the at least one of the outer surface or the primary cooling pathway from the at least one of the plurality of interconnected secondary cooling pathways, wherein the primary flow of the cooling medium flows in the primary cooling pathway prior to the overheating event, and wherein the secondary flow of cooling medium does not flow in the plurality of interconnected secondary cooling pathways until after the overheating event, wherein the primary cooling pathway includes a plurality of primary cooling pathways, the plurality of interconnected secondary cooling pathways is spaced internally from the plurality of primary cooling pathways, wherein each of the plurality of interconnected secondary cooling pathways is laterally offset from and parallels a respective primary cooling pathway.

* * * * *